US008241065B2

(12) United States Patent
Ikari et al.

(10) Patent No.: US 8,241,065 B2
(45) Date of Patent: Aug. 14, 2012

(54) ELECTRICAL CONNECTOR

(75) Inventors: Hiroharu Ikari, Saga (JP); Masao Ishimaru, Saga (JP)

(73) Assignee: Dai-Ichi Seiko Co., Ltd. (JP)

( * ) Notice: Subject to any disclaimer, the term of this patent is extended or adjusted under 35 U.S.C. 154(b) by 0 days.

(21) Appl. No.: 13/038,194

(22) Filed: Mar. 1, 2011

(65) Prior Publication Data

US 2011/0223777 A1 Sep. 15, 2011

(30) Foreign Application Priority Data

Mar. 10, 2010 (JP) ..... 2010-052898

(51) Int. Cl.
*H01R 13/648* (2006.01)

(52) U.S. Cl. ..... 439/607.41; 439/372; 439/495

(58) Field of Classification Search ..... 439/497, 439/495, 372, 607.41–607.49, 607.35, 607.4
See application file for complete search history.

(56) References Cited

U.S. PATENT DOCUMENTS

| | | | | |
|---|---|---|---|---|
| 4,671,594 | A * | 6/1987 | Ohtsuki et al. | 439/347 |
| 6,676,444 | B2 * | 1/2004 | Noro | 439/579 |
| 6,705,893 | B1 * | 3/2004 | Ko | 439/607.56 |
| 6,755,687 | B1 * | 6/2004 | Ko | 439/579 |
| 6,830,478 | B1 * | 12/2004 | Ko | 439/579 |
| 7,094,092 | B2 * | 8/2006 | Yang | 439/495 |
| 7,481,668 | B2 * | 1/2009 | Chiang | 439/492 |
| 7,682,184 | B2 * | 3/2010 | Ko et al. | 439/495 |
| 7,931,493 | B2 * | 4/2011 | Cheng | 439/497 |
| 2005/0227531 | A1 * | 10/2005 | Yang | 439/495 |
| 2006/0134969 | A1 * | 6/2006 | Takaku et al. | 439/495 |
| 2009/0176403 | A1 * | 7/2009 | Yang et al. | 439/495 |
| 2010/0029133 | A1 * | 2/2010 | Cheng | 439/607.47 |

FOREIGN PATENT DOCUMENTS

| | | |
|---|---|---|
| JP | 2006-173051 A | 6/2006 |
| JP | 2009-266749 A | 11/2009 |

* cited by examiner

*Primary Examiner* — Tulsidas C Patel
*Assistant Examiner* — Travis Chambers
(74) *Attorney, Agent, or Firm* — Studebaker & Brackett PC; Donald R. Studebaker

(57) ABSTRACT

An electrical connector comprising an end portion of a flat circuit device which forms a connectively engaging protrusion on which a plurality of contacting terminals are arranged and a supporting board portion for supporting the connectively engaging protrusion, and first and second conductive shells having respectively first and second plate portions opposite to each other with the supporting board portion between, wherein the first conductive shell is attached to the supporting board portion with the first plate portion thereof covering directly a first surface of the supporting board portion and the second conductive shell is attached also to the supporting board portion with the second plate portion thereof covering directly a second surface opposite to the first surface of the supporting board portion, so as to hold the connectively engaging protrusion supported with the supporting board portion for causing the same to engage with a mating electrical connector.

7 Claims, 18 Drawing Sheets

ELECTRICAL CONNECTOR

BACKGROUND OF THE INVENTION

1. Field of the Invention

The present invention relates to an electrical connector for a flat circuit device, such as a flexible printed circuit board (hereinafter, referred to as an FPC), a flexible flat cable assembly (hereinafter, referred to as an FFC) or the like, and more particularly to an improvement in an electrical connector with which contacting terminals provided on a flat circuit device are put in engagement with a mating electrical connector mounted on a main circuit board, such as a solid printed circuit board, to be connect electrically with the same.

2. Description of the Prior Art

A relatively small-sized flat circuit device, such as a relatively small-sized FPC or FFC, used in various kinds of electronic apparatus is often connected electrically with a solid printed circuit board, on which various electrical parts are directly mounted, through an electrical connector which is fixed to and connected electrically with the solid printed circuit board.

For connecting the relatively small-sized flat circuit device electrically with the solid printed circuit board, there has been previously proposed to provide the flat circuit device with a connectively engaging protrusion on which a plurality of contacting terminals are arranged and to put the connectively engaging protrusion of the flat circuit device in electrical engagement with the electrical connector which is fixed to and connected electrically with the solid printed circuit board so that the flat circuit device is electrically connected with the solid printed circuit board through the electrical connector.

In such a previous proposal, a plug type electrical connector is substantially constituted on an end portion of the flat circuit device so as to include the connectively engaging protrusion of the flat circuit device and the plug type electrical connector thus constituted is put in engagement with the electrical connector fixed to and connected electrically with the solid printed circuit board, which functions as a receptacle type electrical connector, as disclosed in, for example, each of Japanese patent applications published before examination under publication numbers 2006-173051 and 2009-266749 (hereinafter, referred to as published patent documents 1 and 2, respectively).

In a previously proposed plug type electrical connector (a connector (101)/(102)/(103)) disclosed in the published patent document 1, an end portion of a flat circuit device (an FFC (50)) is put between a pair of insulated housings (a base insulator (10) and a cover insulator (20)) so that a connectively engaging protrusion at a front end of the flat circuit device, on which a plurality of contacting terminals (conductors (52)) are arranged, is placed to project to the outside of the insulated housings and a pair of conductive shells (a shell (30) and a cover shell (40)) are provided to cover respectively the insulated housings from the outside thereof. The connectively engaging protrusion of the flat circuit device is held by the insulated housings which are opposite to each other with the connectively engaging protrusion between and put between the conductive shells. Then, when the connectively engaging protrusion of the flat circuit device is put in electrical engagement with a connectively engaging opening provided on a receptacle type electrical connector (a mating electrical connector), the contacting terminals arranged on the conductively engaging portion of the flat circuit device are electrically connected with contacts (mating contacts (81)) provided in the receptacle type electrical connector.

Further, in another previously proposed plug type electrical connector (a plug connector (1)) disclosed in the published patent document 2, an end portion of a flat circuit device (a signal transmitting medium (2)) forming a conductively engaging portion on which a plurality of contacting terminals (conductors (21)) are arranged is inserted into an insulated housing (12) through an opening path (12a) provided therein to be fixed to the insulated housing (12) with the conductively engaging portion projecting to the outside of the insulated housing (12) and the insulated housing (12) is put between a pair of conductive shells (a first conductive shell (13a) and a second conductive shell (13b)) opposite to each other. The connectively engaging protrusion of the flat circuit device is held by the insulated housing (12) which is put between the conductive shells opposite to each other and in which the opening path through which the end portion of the flat circuit device forming the conductively engaging portion is inserted in the insulated housing (12) is provided. Then, when the connectively engaging protrusion of the flat circuit device is put in electrical engagement with a connectively engaging opening provided on a receptacle type electrical connector (a mating electrical connector), the contacting terminals arranged on the conductively engaging portion of the flat circuit device are electrically connected with contacts provided in the receptacle type electrical connector.

With each of the previously proposed plug type electrical connectors thus constituted to include the connectively engaging protrusion of the flat circuit device, the connectively engaging protrusion of the flat circuit device is directly engaged with the connectively engaging opening provided in the receptacle type electrical connector so that the contacting terminals arranged on the conductively engaging portion of the flat circuit device come into contact respectively with the contacts provided in the receptacle type electrical connector to be electrically connected through the receptacle type electrical connector with the solid printed circuit board to which the receptacle type electrical connector is fixed.

The previously proposed plug type electrical connector which is constituted to include the connectively engaging protrusion of the flat circuit device, as disclosed in the published patent document 1 or 2, comprises the insulated housings opposite to each other with the end portion of the flat circuit device between or the insulated housing provided therein with the opening path through which the end portion of the flat circuit device is inserted into the insulated housing as a main structural element thereof. Accordingly, in the plug type electrical connector thus proposed previously, at least, there have been disadvantages that a size in a direction of the thickness of the flat circuit device is increased, the constitutive parts are increased in number, the assembling steps and time are increased, the production cost is increased and so on. Further, in the plug type electrical connector thus proposed previously, there has been an additional problem that, since various structural members or parts are positioned with reference to the insulated housing, the insulated housing is required to be processed with extremely high precision.

Besides, in the previously proposed plug type electrical connector disclosed in the published patent document 2, a grounding path from a shielding conductor provided on the flat circuit device through the conductive shell to a ground connecting portion of the receptacle type electrical connector is made relatively long so that variations in distance between the grounding path and each of the contacting terminals arranged on the connectively engaging protrusion of the flat circuit device are brought about. Therefore, it is feared that each of the contacting terminals through which signals are transmitted is varied in its characteristic impedance so that impedance-mismatching is brought about on each of the contacting terminals.

OBJECT AND SUMMARY OF THE INVENTION

Accordingly, it is an object of the present invention to provide an electrical connector which is operative to function as a plug type electrical connector constituted to include a connectively engaging protrusion formed with a part of a flat circuit device, such as an FPC or FFC, on which a plurality of contacting terminals are arranged, and which avoids the aforementioned disadvantages or problems encountered with the prior art.

Another object of the present invention is to provide an electrical connector which is operative to function as a plug type electrical connector constituted to include a connectively engaging protrusion formed with a part of a flat circuit device, such as an FPC or FFC, on which a plurality of contacting terminals are arranged, and with which, at least, a size in a direction of the thickness of the flat circuit device can be reduced, constitutive parts can be reduced in number and assembling steps and time can be reduced.

A further object of the present invention is to provide an electrical connector which is function as a plug type electrical connector constituted to include a connectively engaging protrusion formed with a part of a flat circuit device, such as an FPC or FFC, on which a plurality of contacting terminals are arranged, and in which each of structural members or parts is not required to be processed with extremely high precision.

A still further object of the present invention is to provide an electrical connector which is operative to function as a plug type electrical connector constituted to include a connectively engaging protrusion formed with a part of a flat circuit device, such as an FPC or FFC, on which a plurality of contacting terminals are arranged, and in which variations in characteristic impedance of each of contacting terminals through which signals are transmitted can be effectively suppressed.

According to the present invention, as claimed in any one of claims, there is provided an electrical connector, which comprises an end portion of a flat circuit device which forms a connectively engaging protrusion on which a plurality of contacting terminals are arranged and a supporting board portion for supporting the connectively engaging protrusion, and first and second conductive shells having respectively first and second plate portions facing each other with the supporting board portion formed with the end portion of the flat circuit device between, wherein the first conductive shell is attached to the supporting board portion with the first plate portion thereof covering directly a first surface of the supporting board portion and the second conductive shell is attached also to the supporting board portion with the second plate portion thereof covering directly a second surface opposite to the first surface of the supporting board portion, so that the first and second conductive shells are operative to hold the connectively engaging protrusion supported by the supporting board portion at the end portion of the flat circuit device for causing the same to engage with a mating electrical connector in such a manner that the contacting terminals arranged on the connectively engaging protrusion are exposed to the outside of the first and second conductive shells.

Especially, in a first example of electrical connector according to the present invention, such as claimed in claim 2, a part of a shielding conductor provided on the flat circuit device is exposed on the connectively engaging protrusion supported by the supporting board portion at the end portion of the flat circuit device.

In a second example of electrical connector according to the present invention, such as claimed in claim 3, the first conductive shell is provided with a pressing tongue for coming into press-contact with an end surface between the first and second surfaces of the supporting board portion formed with the end portion of the flat circuit device.

Further, a third example of electrical connector according to the present invention, such as claimed in claim 6, comprises further a connecting member for connecting the first and second conductive shells with each other to be incorporated so that the first and second plate portions of the first and second conductive shells are opposite to each other.

The electrical connector thus constituted in accordance with the present invention is operative to function as a plug type electrical connector to be put in connective engagement with a receptacle type electrical connector.

In the electrical connector according to the present invention, the first conductive shell is attached to the supporting board portion formed with the end portion of the flat circuit device in such a manner that the first plate portion of the first conductive shell covers directly the first surface of the supporting board portion without any insulator or the like put between the first plate portion and the first surface and the second conductive shell is attached also to the supporting board portion formed with the end portion of the flat circuit device in such a manner that the second plate portion of the second conductive shell covers directly the second surface of the supporting board portion without any insulator or the like put between the second plate portion and the second surface. Thereby, the first and second conductive shells are put in a condition for holding the connectively engaging protrusion supported by the supporting board portion at the end portion of the flat circuit device so that the contacting terminals arranged on the connectively engaging protrusion are exposed to the outside of the first and second conductive shells. The connectively engaging protrusion held by the first and second conductive shell is operative to engage with the mating electrical connector functioning as the receptacle type electrical connector.

When the connectively engaging protrusion formed with the end portion of the flat circuit device is put in engagement with the mating electrical connector, the contacting terminals exposed on the connectively engaging protrusion come into press-contact with conductive contacts for signal transmission provided in the mating electrical connector.

In the first example of electrical connector according to the present invention, the part of the shielding conductor provided on the flat circuit device is exposed, in addition to the contacting terminals, on the connectively engaging protrusion supported by the supporting board portion at the end portion of the flat circuit device. Accordingly, the first and second conductive shells are operative to hold the connectively engaging protrusion for causing the same to engage with the mating electrical connector so that the contacting terminals arranged on connectively engaging protrusion and the part of the shielding conductor provided on the connectively engaging protrusion are exposed to the outside of the first and second conductive shell.

In the second example of electrical connector according to the present invention, the pressing tongue is provided on the first conductive shell for coming into press-contact with the end surface between the first and second surfaces of the supporting board portion formed with the end portion of the flat circuit device. The pressing tongue of the first conductive shell is operative to position appropriately and fix stably the first conductive shell in regard to the supporting board portion formed with the end portion of the flat circuit device.

Further, in the third example of electrical connector according to the present invention, the first and second conductive shells are connected through the connecting member with each other to be incorporated. The first plate portion of the first conductive shell and the second plate portion of the second conductive shell are opposite to each other.

As described above, the electrical connector according to the present invention comprises the end portion of the flat circuit device which forms the connectively engaging protrusion and the supporting board portion for supporting the connectively engaging protrusion, the first conductive shell attached to the supporting board portion with the first plate portion thereof covering directly the first surface of the supporting board portion and the second conductive shell attached also to the supporting board portion with the second plate portion thereof covering directly the second surface opposite to the first surface of the supporting board portion, so that the first and second conductive shells are operative to hold the connectively engaging protrusion for causing the same to engage with the mating electrical connector functioning as the receptacle type electrical connector with the contacting terminals arranged on the connectively engaging protrusion to be exposed to the outside of the first and second conductive shells.

Accordingly, with the electrical connector according to the present invention, it is not required to provide an insulated housing or any insulator corresponding to the insulated housing as a structural element. As a result, the electrical connector according to the present invention can be constituted with a reduced size in the direction of the thickness of the flat circuit device, a relatively small number of constructive parts and reduced assembling steps and time and at a production cost reduced effectively. In addition, the electrical connector according to the present invention is not provided with the insulated housing or any insulator corresponding to the insulated housing and therefore the problem that the insulated housing is required to be processed with extremely high precision because various structural members or parts are positioned with reference to the insulated housing, is avoided, and each of the structural members or parts is not required to be processed with extremely high precision.

Especially, in the first example of electrical connector according to the present invention, the contacting terminals and the part of the shielding conductor provided on the flat circuit device is exposed on the connectively engaging protrusion supported by the supporting board portion at the end portion of the flat circuit device and held by the first and second conductive shells, so that, when the connectively engaging protrusion is put in engagement with the mating electrical connector functioning as the receptacle type electrical connector, the contacting terminals come into press-contact with the conductive contacts for signal transmission provided in the mating electrical connector and the shielding conductor comes into press-contact with a ground connecting portion provided in the mating electrical connector. Accordingly, a distance between a grounding path formed with the shielding conductor provided on the flat circuit device and the ground connecting portion provided in the mating electrical connector put in press-contact with the shielding conductor and each of the contacting terminals arranged on the connectively engaging protrusion of the flat circuit device can be kept constant, and therefore, variations in characteristic impedance of each of the contacting terminals through which signals are transmitted can be effectively suppressed.

Further, in the second example of electrical connector according to the present invention, since the pressing tongue provided on the first conductive shell is operative to come into press-contact with the end surface between the first and second surfaces of the supporting board portion formed with the end portion of the flat circuit device so as to position appropriately and fix stably the first conductive shell in regard to the supporting board portion formed with the end portion of the flat circuit device, the first conductive shell can be attached surely to the supporting board portion formed with the end portion of the flat circuit device with a minimized size in the direction of the thickness of the flat circuit device.

Besides, in the third example of electrical connector according to the present invention, since the first and second conductive shells are connected through the connecting member with each other to be incorporated, the first and second conductive shells can be obtained easily and simultaneously, for example, by means of punching and bending a metallic plate and the assembly of the electrical connector using the first and second conductive shells can be easily carried out so as to reduced further the production cost of the electrical connector.

The above, and other objects, features and advantages of the present invention will become apparent from the following detailed description taken in conjunction with the accompanying drawings.

DESCRIPTION OF THE PREFERRED EMBODIMENTS

Embodiments of electrical connector according to the present invention will be explained with reference to FIGS. 1 to 27.

Figure 1:
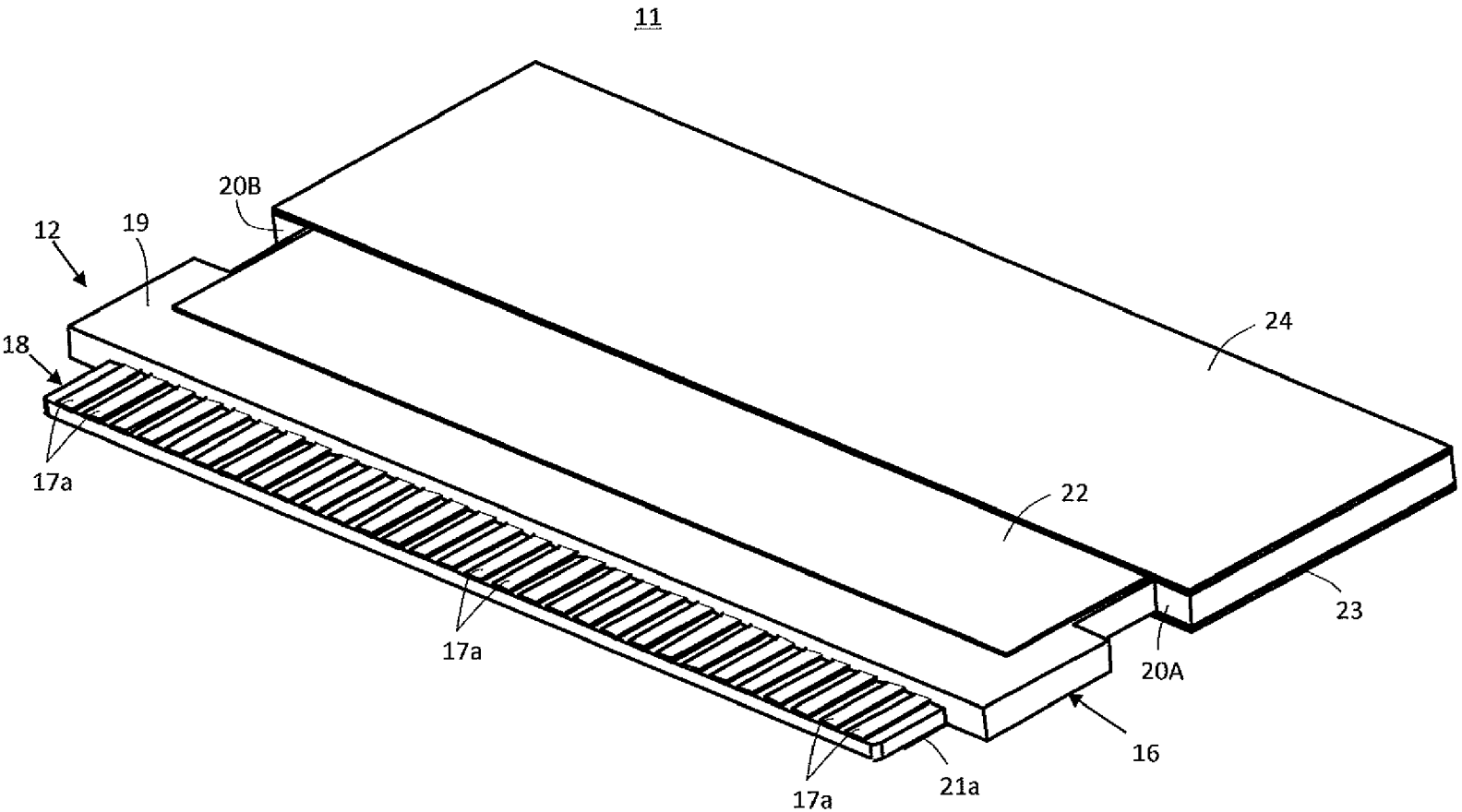
FIG. 1 is a schematic perspective view showing a flat circuit device, an end portion of which constitutes one of constitutive elements of a first embodiment of electrical connector according to the present invention.

FIG. 1 shows a flat circuit device 11 having an end portion 12 thereof which constitutes one of constitutive elements of a first embodiment of electrical connector according to the present invention. The flat circuit device 11 is constituted with an FFC, for example.

Figure 2:
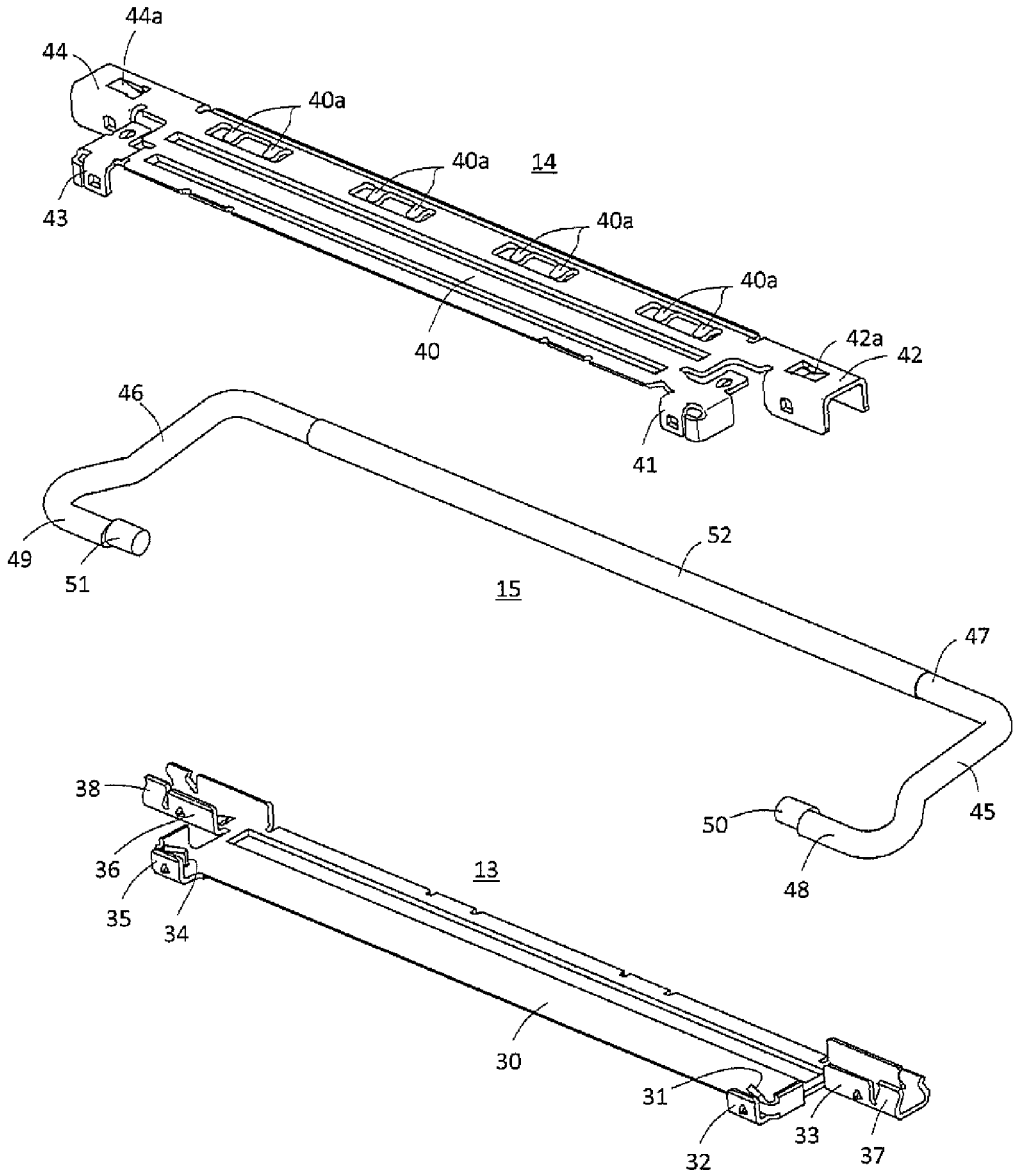
FIG. 2 is a schematic perspective view showing a couple of conductive shells and a manipulative lever constituting the constitutive elements of the first embodiment of electrical connector according to the present invention.

FIG. 2 shows conductive shells 13 and 14 and a manipulative lever 15 which constitutes, together with the end portion 12 of the flat circuit device 11, the constitutive elements of the first embodiment of electrical connector according to the present invention.

Figure 4:
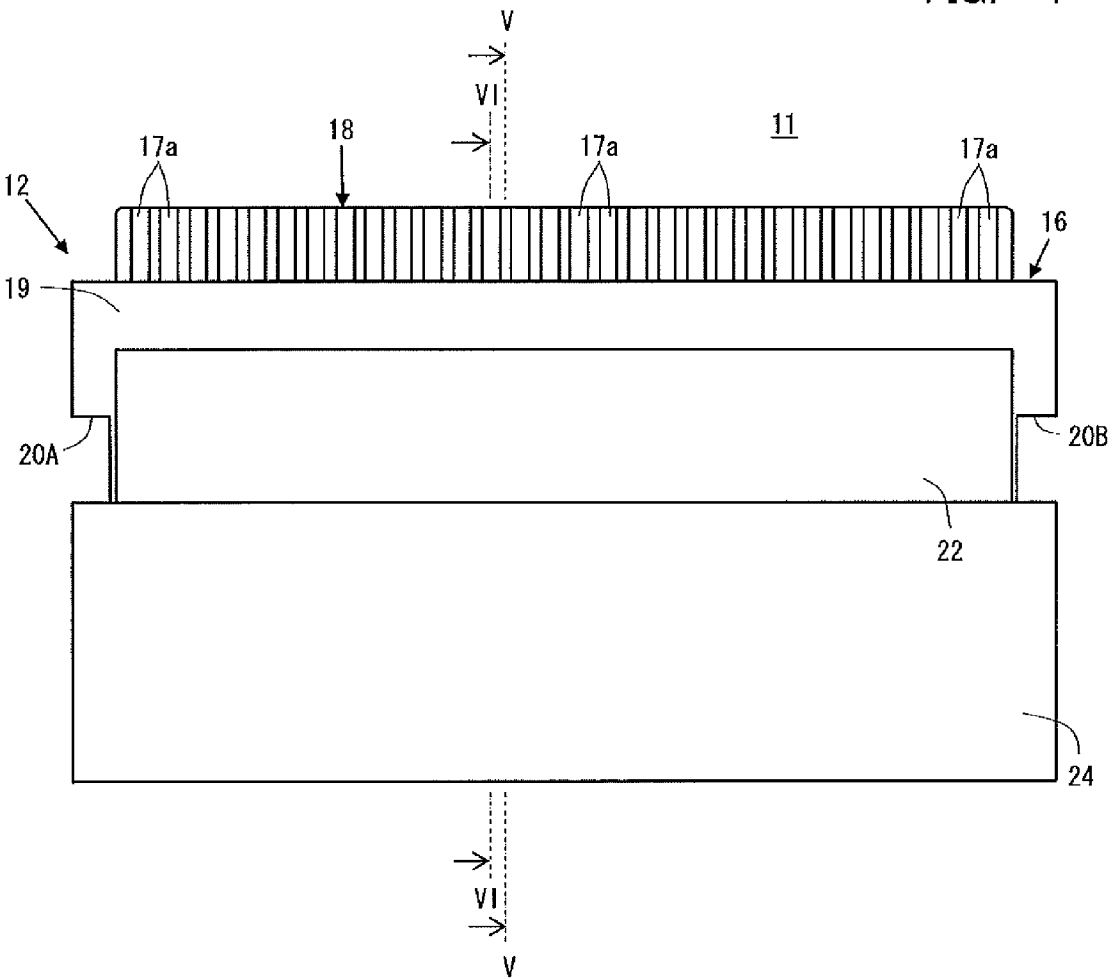
FIG. 4 is a schematic top plan view showing the flat circuit device shown in FIG. 1.
Figure 5:
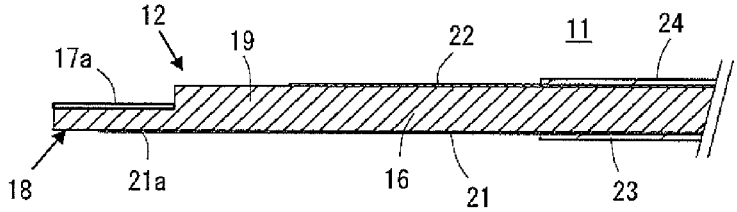
FIG. 5 is a schematic cross sectional view taken along line V-V in FIG. 4.
Figure 6:
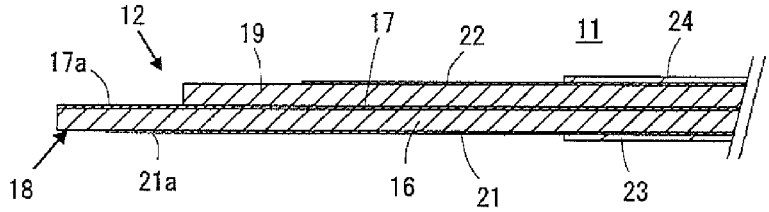
FIG. 6 is a schematic cross sectional view taken along line VI-VI in FIG. 4.

As shown also in FIGS. 3 to 6, the flat circuit device 11 is provided with a board-shaped insulated base 16 and the end portion 12 of the flat circuit device 11 includes the board-shaped insulated base 16. As shown in FIG. 6 which shows a cross sectional view taken along line VI-VI in FIG. 4, a plurality of strip-shaped conductors 17 for transmitting signals arranged substantially in parallel with each other, a cross section of one of which is shown in FIG. 6, are buried in the board-shaped insulated base 16. An end portion of each of the strip-shaped conductors 17 forms a contacting terminal 17*a* exposed to the outside of the board-shaped insulated base 16.

The end portion 12 of the flat circuit device 11 constitutes a connectively engaging protrusion 18 on which a plurality of contacting terminals 17*a* are arranged and a supporting board portion 19 extending in a direction along which the contacting terminals 17*a* are arranged (hereinafter, referred to as a terminal arrangement direction) for supporting the connectively engaging protrusion 18. At both ends in the terminal arrangement direction of a portion of the flat circuit device 11 contiguous to the supporting board portion 19, a pair of engaging edged recesses 20A and 20B are provided.

Figure 3:
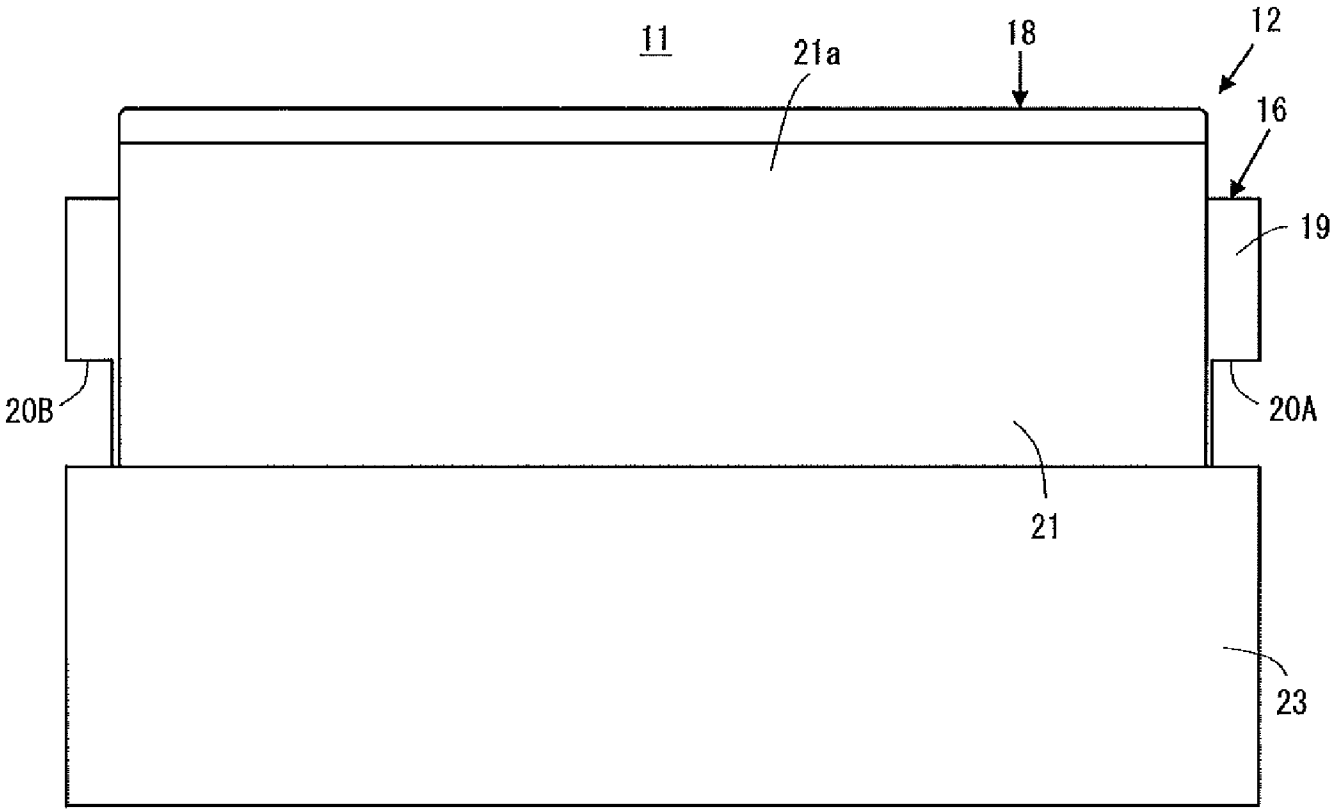
FIG. 3 is a schematic bottom plan view showing the flat circuit device shown in FIG. 1.

As shown clearly also in FIG. 3, FIG. 5 which shows a cross sectional view taken along line V-V in FIG. 4 and FIG. 6, one of a pair of surfaces of the board-shaped insulated base 16 of the flat circuit device 11 opposite to each other is covered with a shielding conductor 21 except portions thereof belonging to a top end portion of the connectively engaging protrusion 18 and both ends in the terminal arrangement direction of the supporting board portion 19. An end portion 21*a* of the shielding conductor 21 is provided on the connectively engaging protrusion 18 so as to be opposite to the contacting terminals 17*a* with the board-shaped insulated base 16 between. Further, as shown clearly also in FIGS. 4 to 6, the other of the surfaces of the board-shaped insulated base 16 of the flat circuit device 11 opposite to each other is covered with a shielding conductor 22 except a portion thereof belonging to a part of the supporting board portion 19. For the sake of convenience, the surface of the supporting board portion 19 on which the shielding conductor 21 is provided is referred to as a first surface and the surface of the supporting board portion 19 on which the shielding conductor 22 is provided is referred to as a second surface. The first and second surfaces of the supporting board portion 19 are opposite to each other.

It is possible to provide one or both of surfaces of the end portion 12 of the flat circuit device 11 opposite to each other with a reinforcing plate member.

The shielding conductor 21 is covered with a protecting film 23 except portions thereof corresponding respectively to a part of the connectively engaging protrusion 18, a major part of the supporting board portion 19 and the portion of the flat circuit device 11 contiguous to the supporting board portion 19 and the shielding conductor 22 is covered with a protecting film 24 except portions thereof corresponding respectively to a part the supporting board portion 19 and the portion of the flat circuit device 11 contiguous to the supporting board portion 19.

Each of the conductive shells 13 and 14 shown in FIG. 2 is formed by means of punching and bending a resilient metallic plate, for example.

Figure 7:
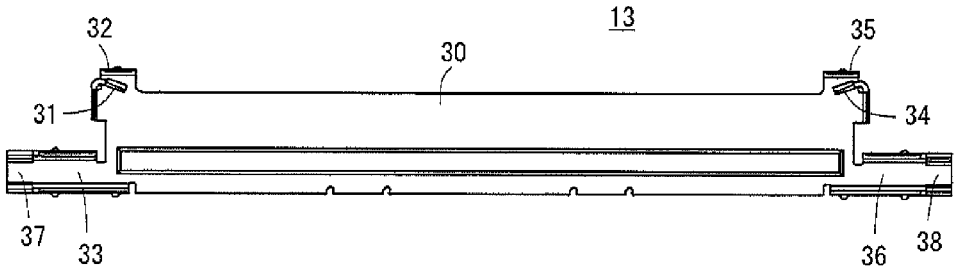
FIG. 7 is a schematic plan view showing one of the conductive shells shown in FIG. 2.

As shown clearly also in FIG. 7 which shows the inside of the conductive shell 13, the conductive shell 13 has a slender plate portion 30. A pressing tongue 31 and engaging portions 32 and 33 are provided on one of end portions of the slender plate portion 30 opposite to each other and a pressing tongue 34 and engaging portions 35 and 36 are provided on the other of end portions of the slender plate portion 30. Further, a stopper member 37 is provided for projecting from the engaging portion 33 to the outside and a stopper member 38 is provided for projecting from the engaging portion 36 to the outside.

Figure 8:
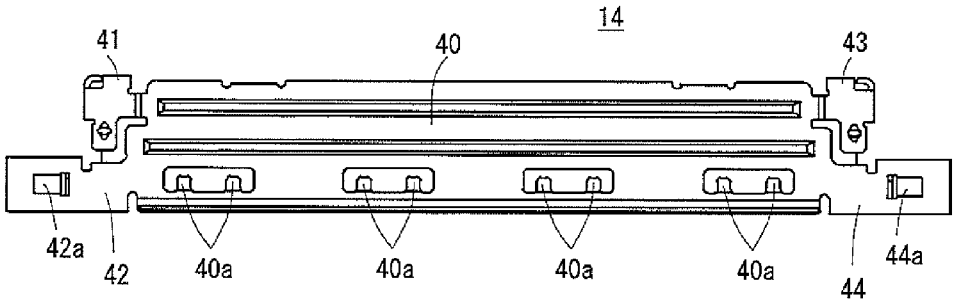
FIG. 8 is a schematic top plan view showing the other of the conductive shells shown in FIG. 2.
Figure 9:
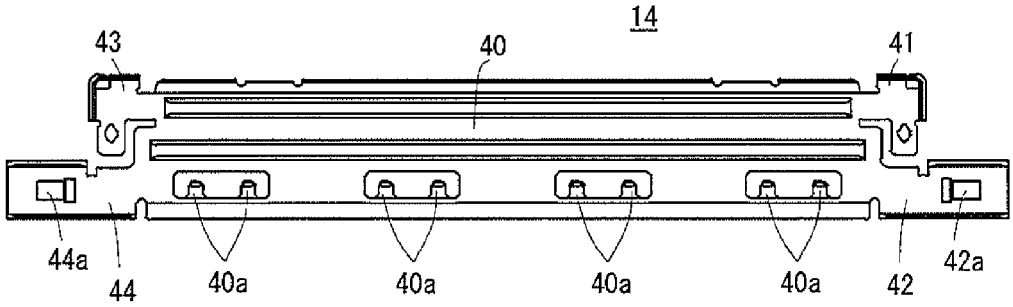
FIG. 9 is a schematic bottom plan view showing the conductive shell shown in FIG. 8.

As shown clearly also in FIG. 8 which shows the outside of the conductive shell 14 and FIG. 9 which shows the inside of the conductive shell 14, the conductive shell 14 has a slender plate portion 40. Engaging portions 41 and 42 are provided on one of end portions of the slender plate portion 40 opposite to each other and engaging portions 43 and 44 are provided on the other of end portions of the slender plate portion 40. In addition, a plurality of pressing tongues 40*a* are formed at predetermined intervals in the slender plate portion 40. Further, a pressing tongue 42*a* is formed in the engaging portion 42 and a pressing tongue 44*a* is formed in the engaging portion 44.

The manipulative lever 15, as shown in FIG. 2, is formed by means of bending a metallic bar, for example. Then, the manipulative lever 15 has a pair of curved arm portions 45 and 46 and a connecting portion 47 through which the curved arm portions 45 and 46 are connected with each other. An end portion 48 of the curved arm portion 45 and an end portion 49 of the curved arm portion 46 are caused to face each other. A top end of the end portion 48 and a top end of the end portion 49 constitute respectively a pair of axial portions 50 and 51 of the manipulative lever 15. An insulated tube 52 is put on the connecting portion 47 to coat the same. It is possible to use an insulated tape or an insulated plastic coating to be provided on the connecting portion 47 in place of the insulated tube 52.

The manipulative lever 15 is mounted to be rotatable on the conductive shell 13 with the end portion 48 thereof held by one of the end portions of the slender plate portion 30 of the conductive shell 13 in such a manner that the axial portion 50 is put in the engaging portion 33 and prevented from getting out of the engaging portion 33 by the stopper member 37 and the end portion 49 held by the other of the end portions of the slender plate portion 30 of the conductive shell 13 in such a manner that the axial portion 51 is put in the engaging portion 36 and prevented from getting out of the engaging portion 36 by the stopper member 38.

Figure 10:
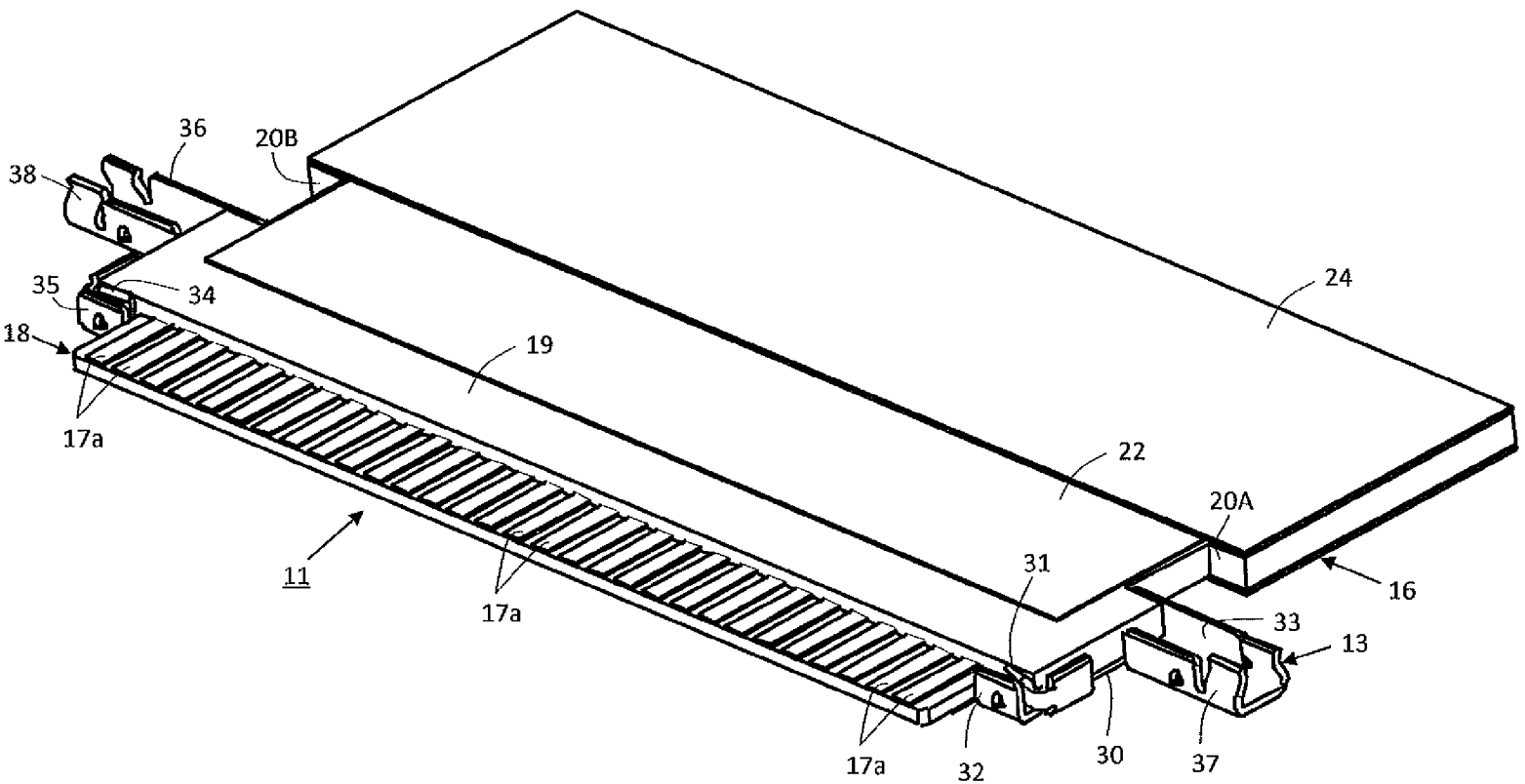
FIG. 10 is a schematic perspective view showing the flat circuit device shown in FIG. 1 and the conductive shell shown in FIG. 7 and attached to the flat circuit device.

As shown in FIG. 10, the conductive shell 13 is placed to be attached to the supporting board portion 19 of the flat circuit device 11. When the conductive shell 13 is attached to the supporting board portion 19, an inner surface of the slender plate portion 30 of the conductive shell 13 is placed to face the first surface of the supporting board portion 19. Then, a portion of the engaging portion 33 of the conductive shell 13 is put in engagement with the engaging edged recess 20A provided on the flat circuit device 11, a portion of the engaging portion 36 of the conductive shell 13 is put in engagement with the engaging edged recess 20B provided on the flat circuit device 11, and the pressing tongues 31 and 34 of the conductive shell 13 come into press-contact with an end surface provided between the first and second surfaces of the supporting board portion 19 to be perpendicular to each of the first and second surfaces, so that the conductive shell 13 is positioned appropriately to the supporting board portion 19. As a result, the conductive shell 13 is attached to the supporting board portion 19 of the flat circuit device 11 with the slender plate portion 30 thereof which covers directly the first surface of the supporting board portion 19 without any insulator or the like put between the slender plate portion 30 and the first surface of the supporting board portion 19.

Figure 11:
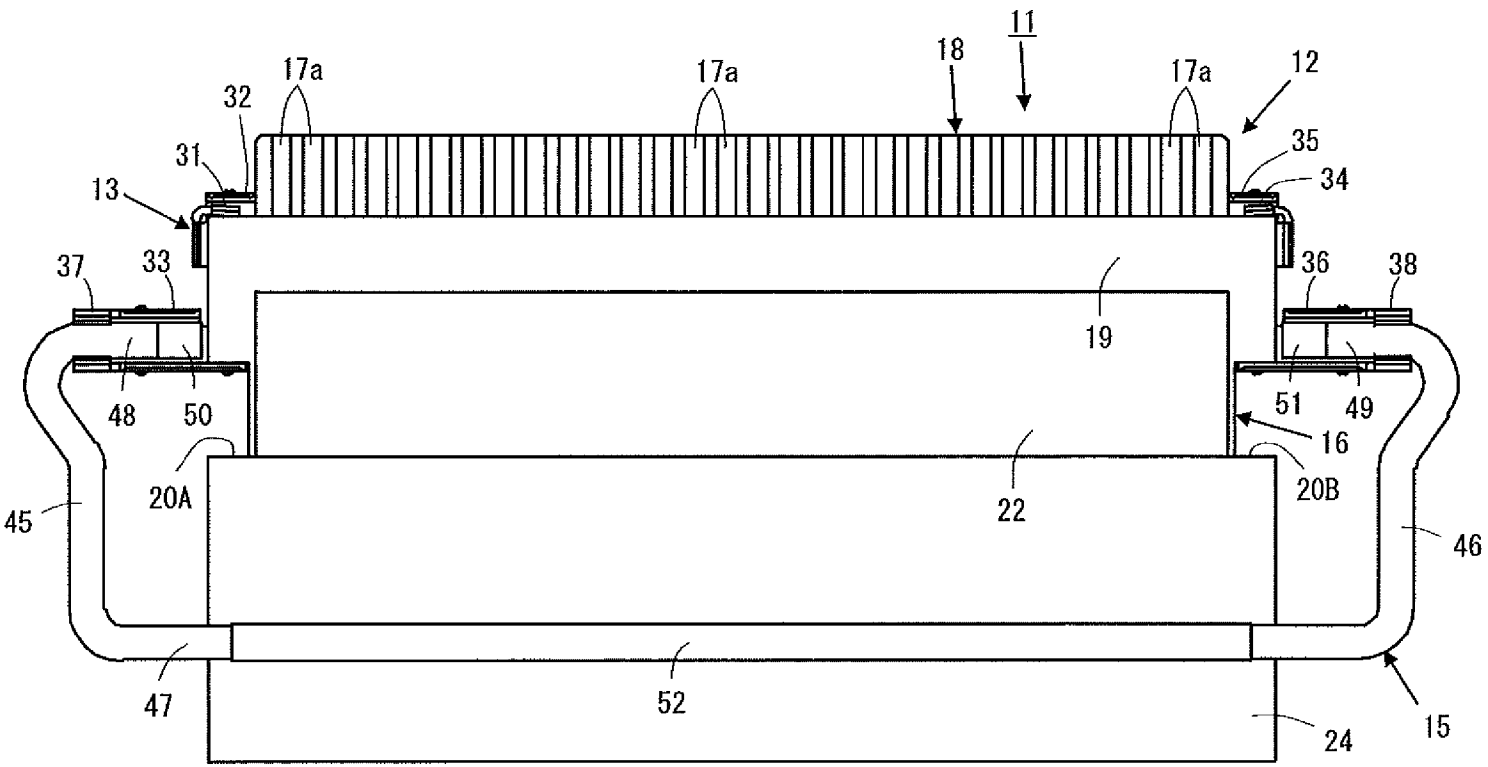
FIG. 11 is a schematic plan view showing the flat circuit device and the conductive shell shown in FIG. 10 and the manipulative lever shown in FIG. 2 and mounted on the conductive shell.

Next, the manipulative lever 15 is put in process of mounting on the conductive shell 13 which is attached to the supporting board portion 19 of the flat circuit device 11. When the manipulative lever 15 is mounted on the conductive shell 13, the end portion 48 of the manipulative lever 15 is held to be rotatable by one of the end portions of the slender plate portion 30 of the conductive shell 13 in such a manner that the axial portion 50 provided on the end portion 48 is put in the engaging portion 33 of the conductive shell 13 and prevented from getting out of the engaging portion 33 by the stopper member 37 of the conductive shell 13 and the end portion 49 of the manipulative lever 15 is held to be rotatable by the other of the end portions of the slender plate portion 30 of the conductive shell 13 in such a manner that the axial portion 51 provided on the end portion 49 is put in the engaging portion 36 of the conductive shell 13 and prevented from getting out of the engaging portion 36 by the stopper member 38 of the conductive shell 13, as shown in FIG. 11. As a result, the manipulative lever 15 is mounted to be rotatable on the conductive shell 13.

After that, the conductive shell 14 is put in process of attachment to the conductive shell 13 which is attached to the supporting board portion 19 of the flat circuit device 11. When the conductive shell 14 is attached to the conductive shell 13, an inner surface of the slender plate portion 40 of the conductive shell 14 is placed to face the second surface of the supporting board portion 19. Then, the engaging portions 41 and 43 of the conductive shell 14 are put in engagement respectively with the engaging portions 32 and 35 of the conductive shell 13 and the engaging portions 42 and 44 of the conductive shell 14 are put in engagement respectively with the engaging portions 33 and 36 of the conductive shell 13, so that the conductive shell 14 is positioned appropriately to the supporting board portion 19 of the flat circuit device 11 to which the conductive shell 13 is attached. As a result, as shown in FIG. 12, the conductive shell 14 is attached to the conductive shell 13 which is attached to the supporting board portion 19 of the flat circuit device 11 with the slender plate portion 40 thereof which covers directly the second surface of the supporting board portion 19 without any insulator or the like put between the slender plate portion 40 and the second surface of the supporting board portion 19 and with the pressing tongues 42*a* and 44*a* formed respectively in the engaging portions 42 and 44 which are operative to restrain in position the end portions 48 and 49 of the manipulative lever 15 put respectively in the engaging portions 33 and 36 of the conductive shell 13.

Figure 12:
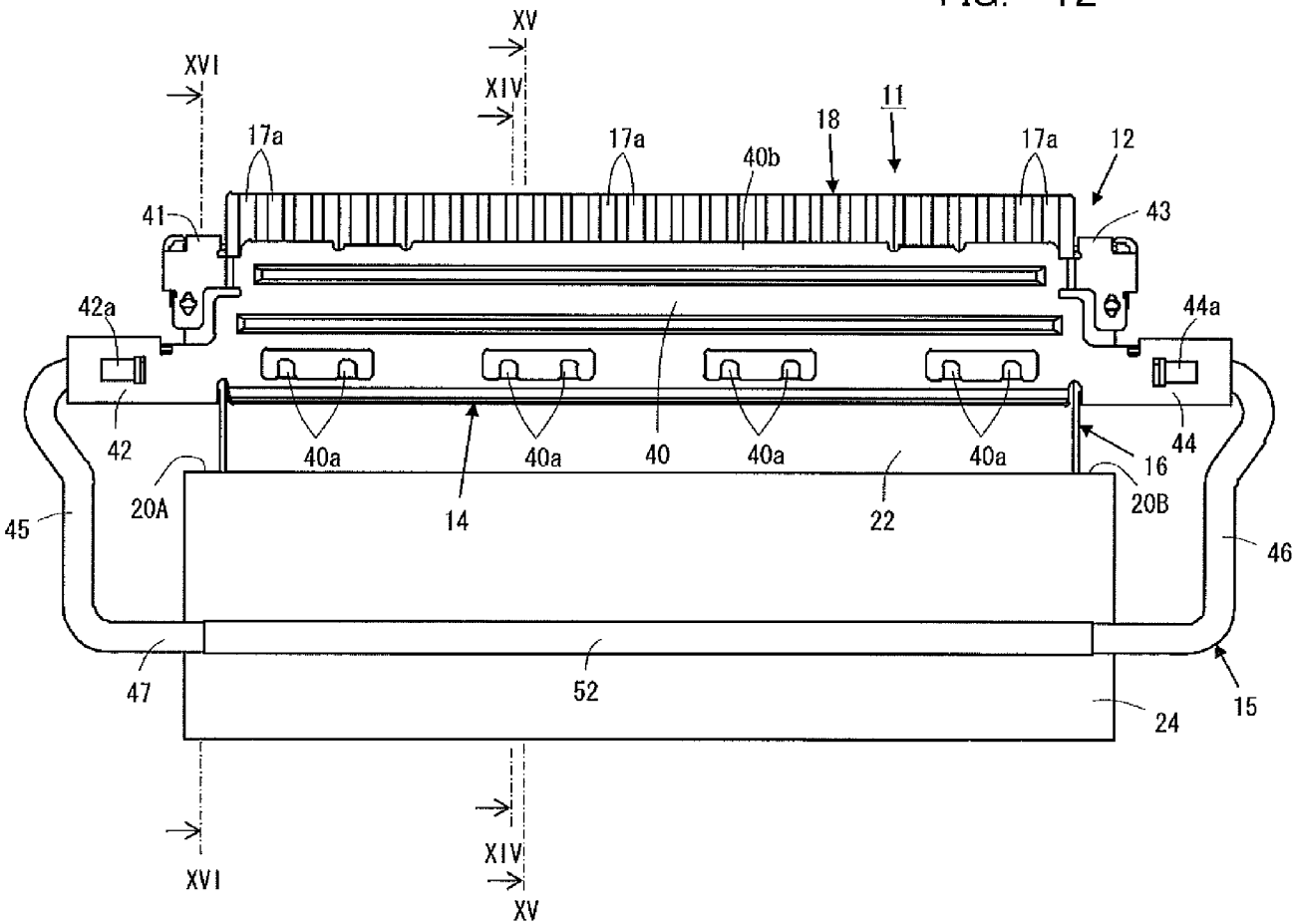
FIG. 12 is a schematic top plan view showing the first embodiment of electrical connector according to the present invention.

Under a condition wherein the conductive shell 13 is attached to the supporting board portion 19 constituted with the end portion 12 of the flat circuit device 11, the manipulative lever 15 is mounted to be rotatable on the conductive shell 13 and the conductive shell 14 is attached to the conductive shell 13 which is attached to the supporting board portion 19 in such a manner as described above, as shown also in FIGS. 14, 15 and 16 which show cross sectional views taken along lines XIV-XIV, XV-XV and XVI-XVI in FIG. 12, respectively, the slender plate portion 30 of the conductive shell 13 and the slender plate portion 40 of the conductive shell 14 are located to be opposite to each other with the supporting board portion 19 between. The slender plate portion 30 of the conductive shell 13 covers directly the first surface of the supporting board portion 19 and the slender plate portion 40 of the conductive shell 14 covers directly the second surface of the supporting board portion 19.

Figure 15:
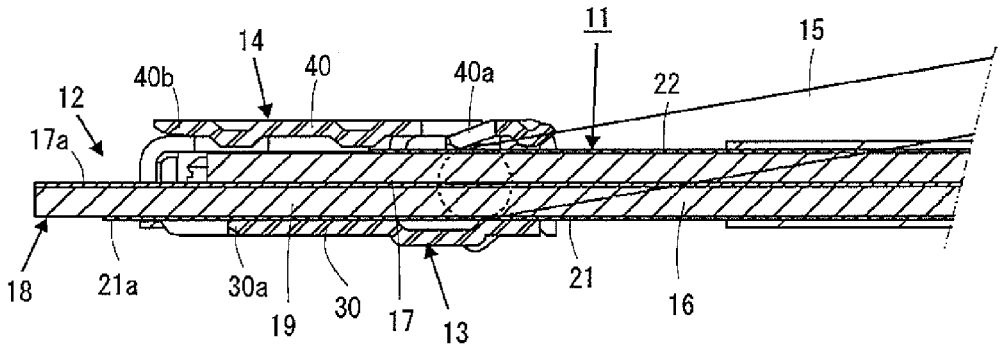
FIG. 15 is a schematic cross sectional view taken along line XV-XV in FIG. 12.
Figure 16:
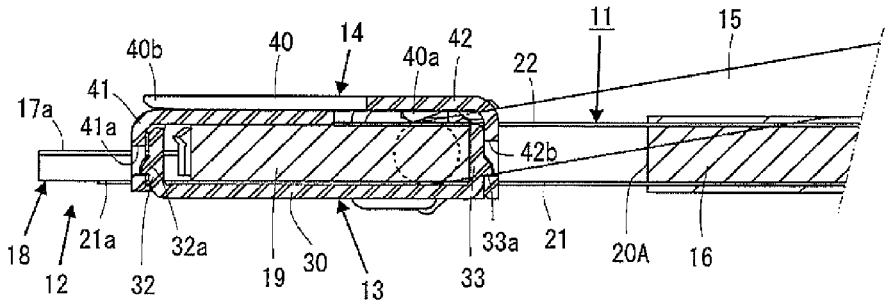
FIG. 16 is a schematic cross sectional view taken along line XVI-XVI in FIG. 12.

Further, as shown in FIGS. 15 and 16, the slender plate portion 30 of the conductive shell 13 covering the first surface of the supporting board portion 19 comes directly and electrically into contact with the shielding conductor 21 provided on the supporting board portion 19, and thereby, the conductive shell 13 is electrically connected with the shielding conductor 21. Similarly, the pressing tongue 40*a* formed in the slender plate portion 40 of the conductive shell 14 covering the second surface of the supporting board portion 19 comes electrically into press-contact with the shielding conductor 22 provided on the supporting board portion 19, and thereby, the conductive shell 14 is electrically connected with the shielding conductor 22.

It is also possible to solder each of the conductive shells 13 and 14 to the shielding conductor 21 or the shielding conductor 22 for connecting the each of the conductive shells 13 and 14 electrically with the shielding conductor 21 or the shielding conductor 22.

As shown in FIG. 16, an engaging aperture 41*a* formed in the engaging portion 41 of the conductive shell 14 engages with an engaging projection 32*a* provided on the engaging portion 32 of the conductive shell 13 so that the engaging portion 41 of the conductive shell 14 is engaged with the engaging portion 32 of the conductive shell 13. Similarly, an engaging aperture 42*b* formed in the engaging portion 42 of the conductive shell 14 engages with an engaging projection 33*a* provided on the engaging portion 33 of the conductive shell 13 so that the engaging portion 42 of the conductive shell 14 is engaged with the engaging portion 33 of the conductive shell 13.

Although detailed illustrations in the drawings are omitted, the engagement of the engaging portion 43 of the conductive shell 14 with the engaging portion 35 of the conductive shell 13 and the engagement of the engaging portion 44 of the conductive shell 14 with the engaging portion 36 of the conductive shell 13 are carried out in the same manner as the engagement of the engaging portion 41 of the conductive shell 14 with the engaging portion 32 of the conductive shell 13 and the engagement of the engaging portion 42 of the conductive shell 14 with the engaging portion 33 of the conductive shell 13, respectively.

Figure 14:
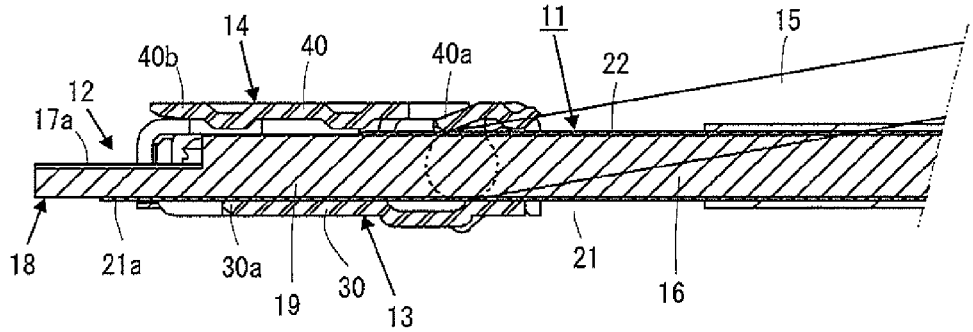
FIG. 14 is a schematic cross sectional view taken along line XIV-XIV in FIG. 12.

Then, as shown in FIGS. 12, 14 and 15, the connectively engaging protrusion 18 on which the contacting terminals 17*a* are arranged projects from an end portion 40*b* between the engaging portions 41 and 43 provided on the slender plate portion 40 of the conductive shell 14 covering the second surface of the supporting board portion 19 to the outside so that the contacting terminals 17*a* are exposed on one of a pair of mutually opposite surfaces of the connectively engaging protrusion 18.

Figure 13:
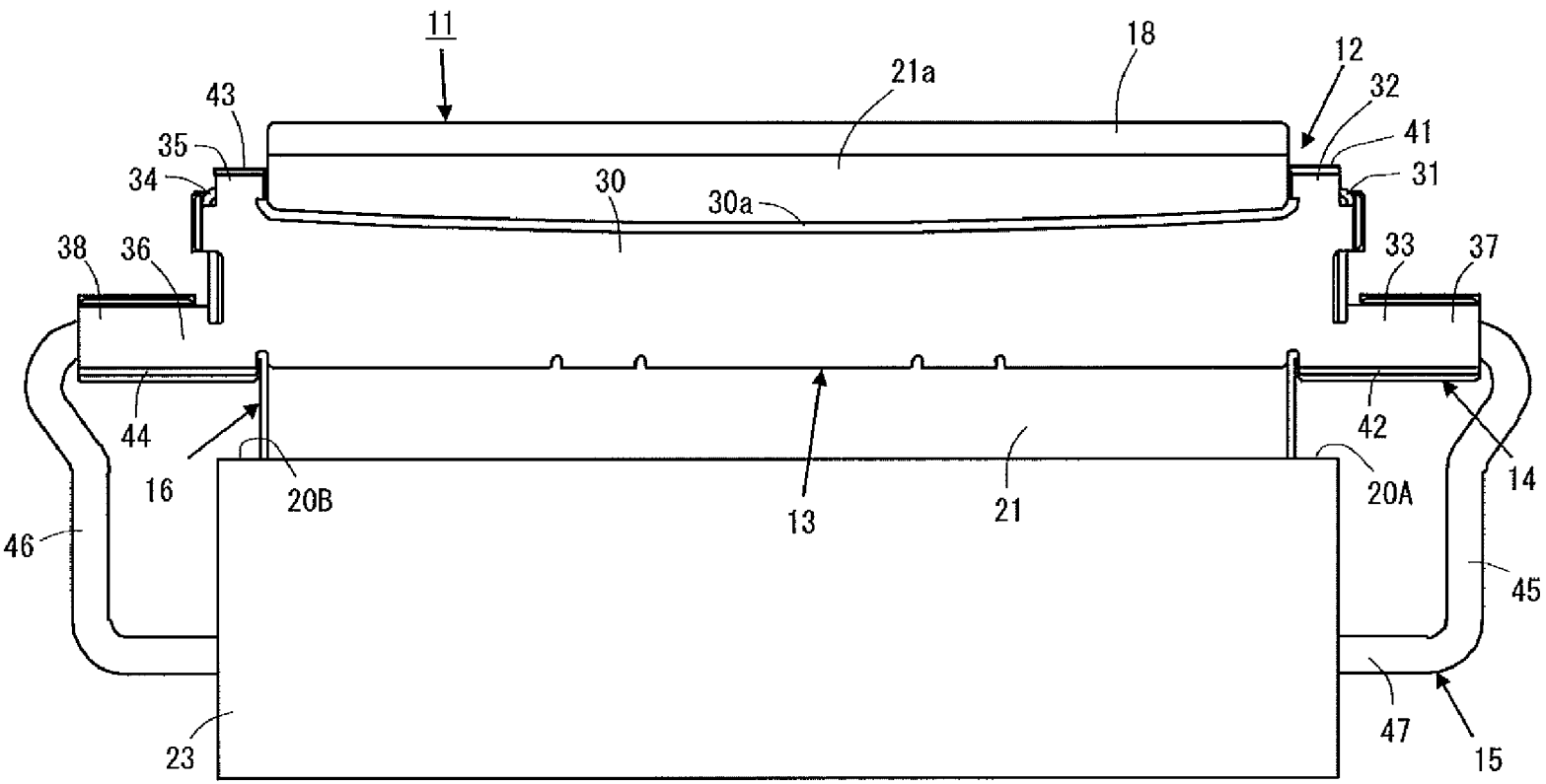
FIG. 13 is a schematic bottom plan view showing the first embodiment of electrical connector according to the present invention.

Further, as shown in FIGS. 13, 14 and 15, the connectively engaging protrusion 18 on which the end portion 21*a* of the shielding conductor 21 is provided projects from an end portion 30*a* between the engaging portions 32 and 35 provided on the slender plate portion 30 of the conductive shell 13 covering the first surface of the supporting board portion 19 to the outside so that the end portion 21*a* of the shielding conductor 21 extending along the terminal arrangement direction is exposed on the other of the mutually opposite surfaces of the connectively engaging protrusion 18.

As a result, the conductive shell 13 having the slender plate portion 30 which covers directly the first surface of the supporting board portion 19 constituted with the end portion 12 of the flat circuit device 11 and the conductive shell 14 having the slender plate portion 40 which covers directly the second surface of the supporting board portion 19 and is positioned across the supporting board portion 19 from the slender plate portion 30, are placed to hold the connectively engaging protrusion 18 supported by the supporting board portion 19 in such a manner that the contacting terminals 17*a* and the end portion 21*a* of the shielding conductor 21 are exposed on the connectively engaging protrusion 18, and thereby, the first embodiment of electrical connector according to the present invention is obtained. The first embodiment of electrical connector thus obtained in accordance with the present invention functions as a plug type electrical connector operative to be engaged with a mating electrical connector functioning as a receptacle type electrical connector.

Accordingly, in the first embodiment of electrical connector according to the present invention, the conductive shells 13 and 14 hold the connectively engaging protrusion 18 so as to cause the connectively engaging protrusion 18 to be engaged with the mating electrical connector with the contacting terminals 17*a* and the end portion 21*a* of the shielding conductor 21 exposed thereon.

Figure 17:
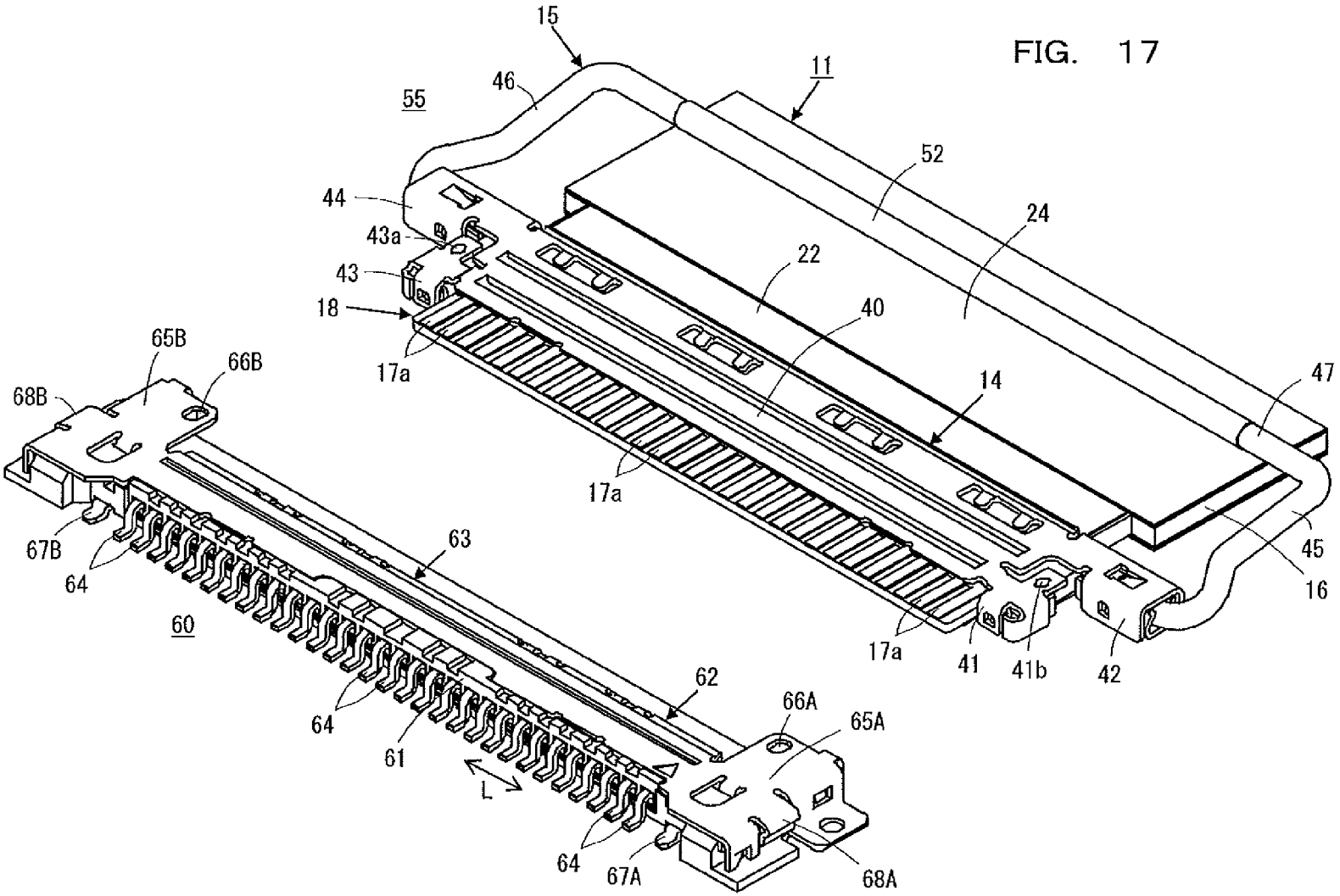
FIG. 17 is a schematic perspective view showing the first embodiment of electrical connector according to the present invention and a mating electrical connector with which the first embodiment is to be put in engagement.

FIG. 17 shows a plug type electrical connector 55 constituting the first embodiment of electrical connector according to the present invention which is obtained in such a manner as mentioned above and a receptacle type electrical connector 60 constituting a mating electrical connector with which the plug type electrical connector 55 is put in engagement.

Referring to FIG. 17, the receptacle type electrical connector 60 is fixed to a solid printed circuit board (not shown in the drawings) to be electrically connected with an electric circuit portion provided on the solid printed circuit board, so that the plug type electrical connector 55 is put in engagement with the receptacle type electrical connector 60 fixed to the solid printed circuit board. The receptacle type electrical connector 60 comprises an insulated housing 61 made of insulator such as plastics or the like and a conductive shell 62 covering a major part of an outside surface of the insulated housing 61, which is formed by means of processing a resilient metallic plate and grounded to be operative to shield the receptacle type electrical connector 60 from electromagnetic wave noises coming from the outside.

On the insulated housing 61 and the conductive shell 62, a connectively engaging opening 63 is provided to extend in a longitudinal direction of the insulated housing 61 (which is indicated with arrow L in FIG. 17, and hereinafter, referred to an L direction). Further, the insulated housing 61 is provided thereon with a plurality of conductive contacts 64 for transmitting signals each formed by means of bending a resilient metallic strip member. The conductive contacts 64 are arranged in the L direction on the insulated housing 61. One of end portions of each of the conductive contacts 64 projecting from the insulated housing 61 toward the outside thereof constitutes a connecting terminal operative to be electrically connected with the electric circuit portion provided on the solid printed circuit board to which the receptacle type electrical connector 60 is fixed. The other of the end portions of each of the conductive contacts 64 is located in the connectively engaging opening 63 to constitute a connecting portion, with which a corresponding one of the contacting terminals 17*a* arranged on the connectively engaging protrusion 18 of the plug type electrical connector 55 comes into contact when the connectively engaging protrusion 18 of the plug type electrical connector 55 is engaged with the connectively engaging opening 63.

Engaging apertures 66A and 66B are provided respectively on end portions 65A and 65B in the L direction of the conductive shell 62. An engaging projection 41*b* formed in the engaging portion 41 and an engaging projection 43*a* formed in the engaging portion 43 provided on the conductive shell 14 of the plug type electrical connector 55 are put in engagement respectively with the engaging apertures 66A and 66B when the connectively engaging protrusion 18 of the plug type electrical connector 55 is engaged with the connectively engaging opening 63 provided on the insulated housing 61 and the conductive shell 62.

The conductive shell 62 is also provided with grounding terminals 67A and 67B which are located respectively at portions of the conductive shell 62 opposite to each other with the conductive contacts 64 between. Each of the grounding terminals 67A and 67B extends from the insulated housing 61 to the outside thereof so as to be electrically connected with a grounding portion provided on the solid printed circuit board to which the receptacle type electrical connector 60 is fixed. Therefore, the conductive shell 62 constitutes a ground connecting portion of the receptacle type electrical connector 60.

Further, the end portions 65A and 65B of the conductive shell 62 are provided respectively with resilient engaging portions 68A and 68B. The resilient engaging portions 68A and 68B are operative to engage respectively with the curved arm portions 45 and 46 of the manipulative lever 15 provided in the plug type electrical connector 55 and manipulated to rotate when the connectively engaging protrusion 18 of the plug type electrical connector 55 is engaged with the connectively engaging opening 63 provided on the insulated housing 61 and the conductive shell 62.

The receptacle type electrical connector 60 thus constituted is fixed to the solid printed circuit board to be electrically connected with the electric circuit portion provided thereon in such a manner that the contacting terminal at the end of each of the conductive contact 64 is electrically connected with a circuit pattern on the solid printed circuit board and the grounding terminals 67A and 67B are electrically connected with the grounding portion provided on the solid printed circuit board.

Figure 20:
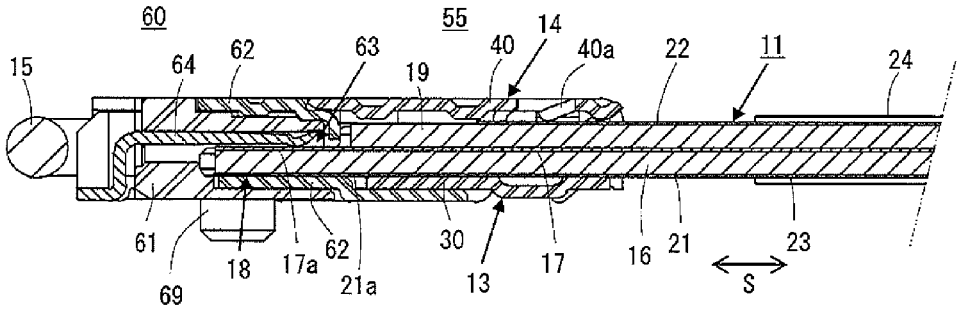
FIG. 20 is a schematic cross sectional view taken along line XX-XX in FIG. 19.
Figure 21:
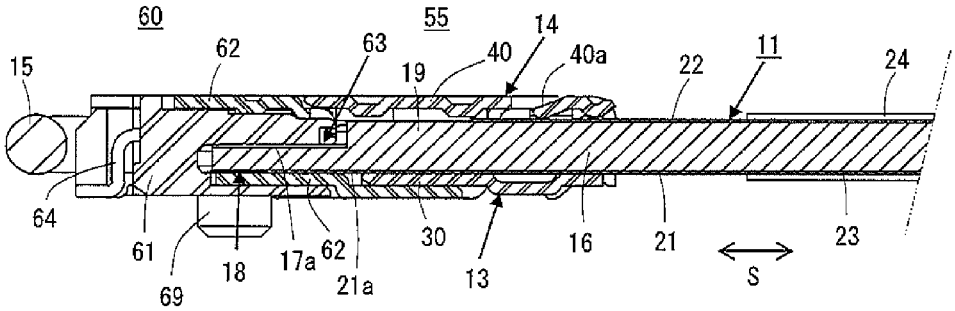
FIG. 21 is a schematic cross sectional view taken along line XXI-XXI in FIG. 19.
Figure 18:
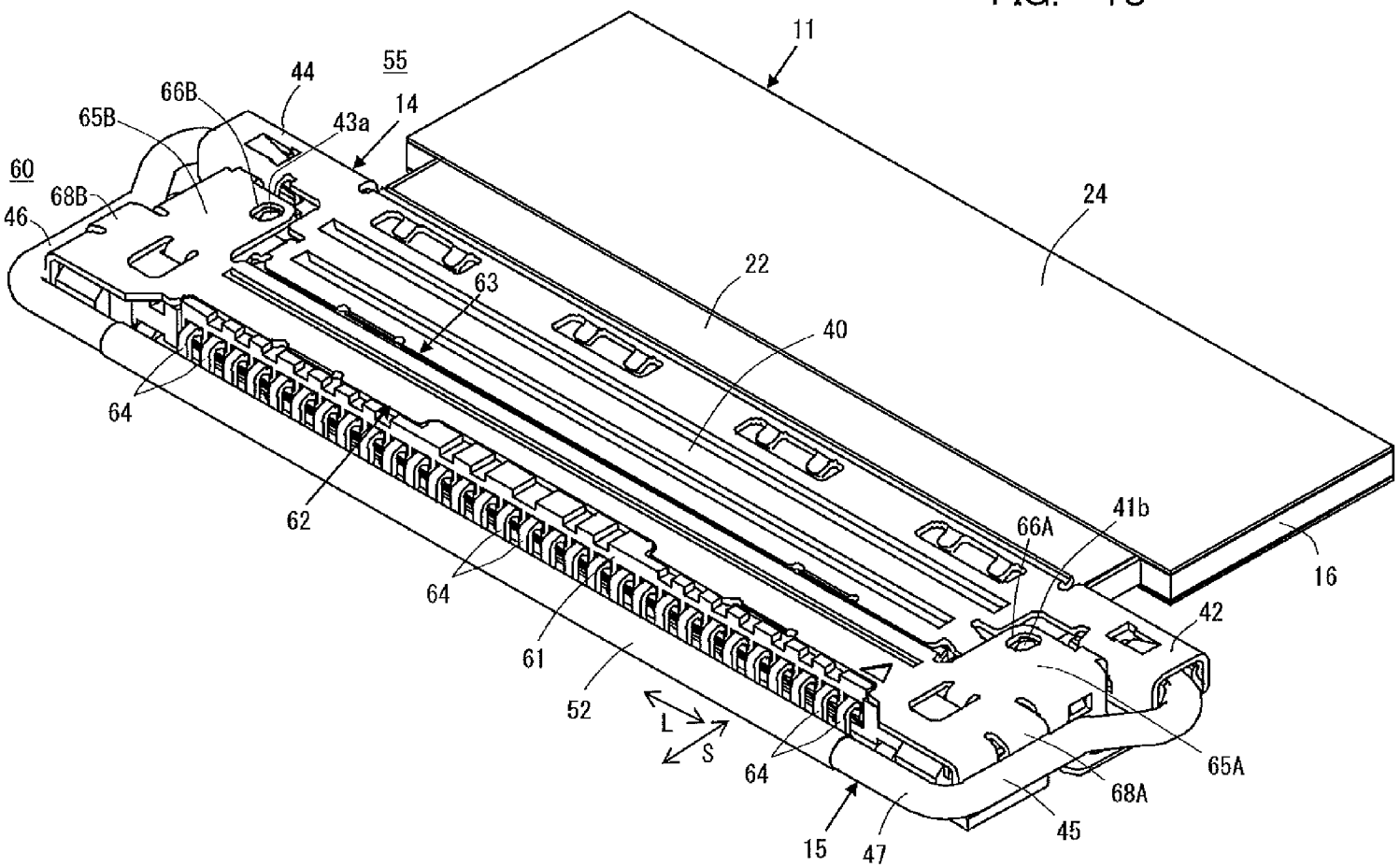
FIG. 18 is a schematic perspective view showing the first embodiment of electrical connector according to the present invention and the mating electrical connector which are put in engagement with each other.
Figure 19:
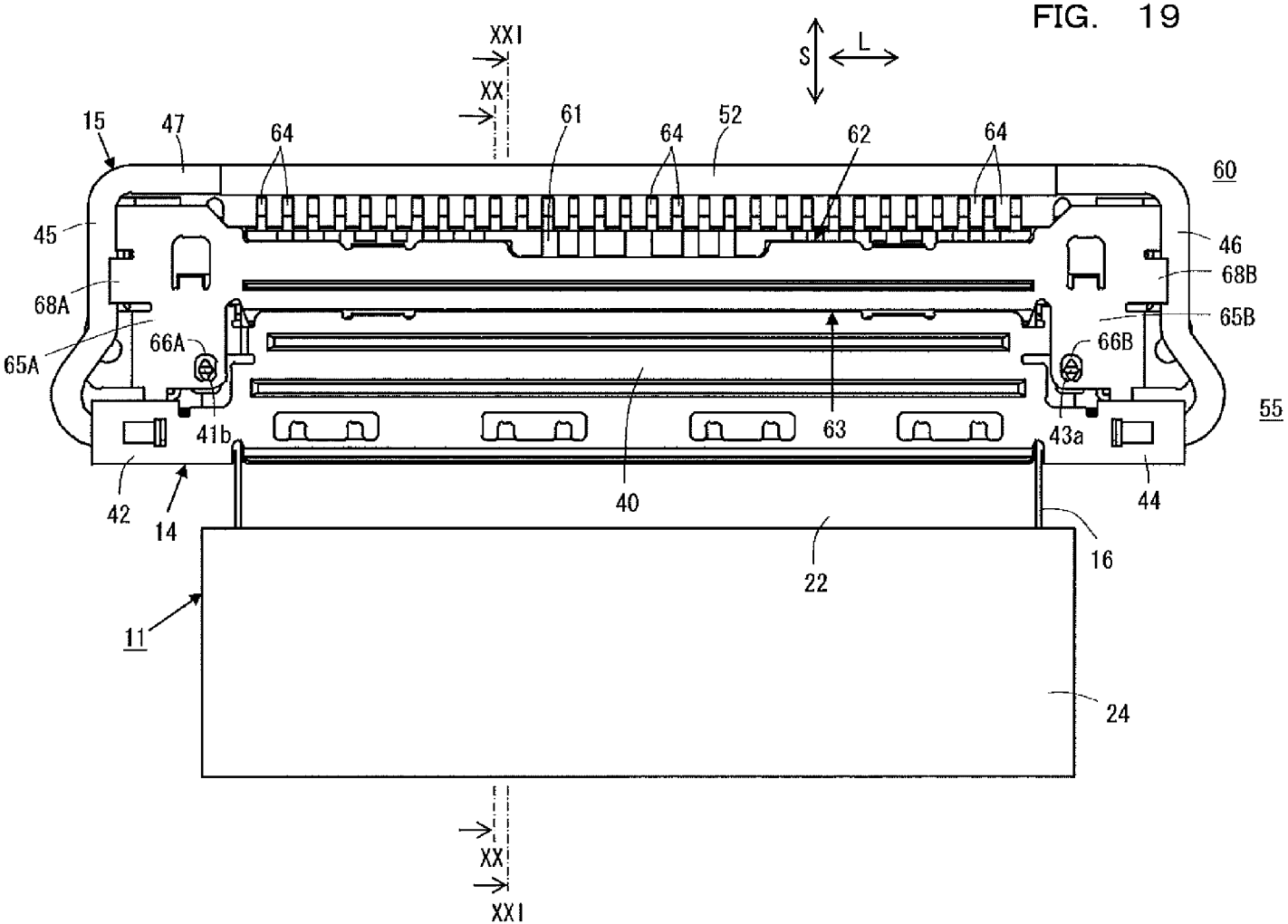
FIG. 19 is a schematic plan view showing the first embodiment of electrical connector according to the present invention and the mating electrical connector which are put in engagement with each other.

When the plug type electrical connector 55 is put in engagement with the receptacle type electrical connector 60 fixed to the solid printed circuit board, as shown in FIG. 18 (a schematic perspective view), FIG. 19 (a schematic plan view), FIG. 20 which shows a cross sectional view taken along line XX-XX in FIG. 19 and FIG. 21 which shows a cross sectional view taken along line XXI-XXI in FIG. 19, the connectively engaging protrusion 18 of the plug type electrical connector 55 is inserted in a direction perpendicular to the L direction (which is indicated with arrow S in FIG. 18, and hereinafter, referred to an S direction) into the connectively engaging opening 63 provided on the insulated housing 61 and the conductive shell 62 of the receptacle type electrical connector 60 to be engaged with the same.

Under a condition wherein the connectively engaging protrusion 18 of the plug type electrical connector 55 is thus engaged with the connectively engaging opening 63 provided on the insulated housing 61 and the conductive shell 62 of the receptacle type electrical connector 60, the engaging projections 41*b* and 43*a* formed respectively in the engaging portions 41 and 43 provided on the conductive shell 14 of the plug type electrical connector 55 are engaged respectively with the engaging apertures 66A and 66B provided on the conductive shell 62 of the receptacle type electrical connector 60. Thereby, the conductive shell 14 and the conductive shell 62 are put in contact with each other and the connectively engaging protrusion 18 of the plug type electrical connector 55 and the connectively engaging opening 63 of the receptacle type electrical connector 60 are stably maintained in engagement with each other.

Further, under the condition mentioned above, the manipulative lever 15 provided in the plug type electrical connector 55 is manipulated to rotate from a first station wherein the connecting portion 47 of the manipulative lever 15 coated by the insulated tube 52 is put on the side of the protecting film 24 on the flat circuit device 11 to a second station wherein the connecting portion 47 of the manipulative lever 15 is put on the side of the connectively engaging protrusion 18 of the plug type electrical connector 55, as shown in FIGS. 18 to 21.

When the manipulative lever 15 provided in the plug type electrical connector 55 takes up the second station as shown in FIGS. 18 to 21, the curved arm portions 45 and 46 of the manipulative lever 15 are caused to ride respectively across protrusions on the resilient engaging portions 68A and 68B provided on the conductive shell 62 of the receptacle type electrical connector 60 so as to engage with the resilient engaging portions 68A and 68B. Thereby, the manipulative lever 15 is stationed on the receptacle type electrical connector 60 and the plug type electrical connector 55 and the receptacle type electrical connector 60 are maintained in mutual engagement.

Incidentally, although the first embodiment of electrical connector according to the present invention, namely, the plug type electrical connector 55 mentioned above, is provided with the manipulative lever 15, it is not always necessary for the electrical connector according to the present invention to have the manipulative lever 15 or any other member corresponding to the manipulative lever 15. That is, the electrical connector according to the present invention can be constituted without the manipulative lever 15 or any other member corresponding to the manipulative lever 15.

Then, under the condition wherein the connectively engaging protrusion 18 of the plug type electrical connector 55 is inserted in the connectively engaging opening 63 provided on the insulated housing 61 and the conductive shell 62 of the receptacle type electrical connector 60 to be engaged with the same, in the connectively engaging opening 63 provided on the insulated housing 61, each of the conductive contacts 64 provided in the receptacle type electrical connector 60 comes into press-contact with a corresponding one of the contacting terminals 17*a* arranged on the connectively engaging protrusion 18 of the plug type electrical connector 55, as shown in FIG. 20. Thereby, the contacting terminals 17*a* are electrically connected with the conductive contacts 64 and a signal transmission can be carried out between the strip-shaped conductors 17 buried in the board-shaped insulated base 16 of the flat circuit device 11 and the conductive contacts 64. As a result, a signal transmission between the flat circuit device 11 on the side of the plug type electrical connector 55 and the electric circuit portion provided on the solid printed circuit board to which the receptacle type electrical connector 60 is fixed is carried out thorough the plug type electrical connector 55 and the receptacle type electrical connector 60.

Further, under the condition wherein the connectively engaging protrusion 18 of the plug type electrical connector 55 is inserted in the connectively engaging opening 63 provided on the insulated housing 61 and the conductive shell 62 of the receptacle type electrical connector 60 to be engaged with the same, the end portion 21*a* of the shielding conductor 21 provided on the connectively engaging protrusion 18 comes directly into press-contact with the conductive shell 62 of the receptacle type electrical connector 60, as shown in FIGS. 20 and 21. In addition, the slender plate portion 30 of the conductive shell 13 of the plug type electrical connector 55 comes also into contact with the conductive shell 62 of the receptacle type electrical connector 60.

Therefore, the shielding conductor 21 of the flat circuit device 11 on the side of the plug type electrical connector 55 is connected directly with the conductive shell 62 constituting the ground connecting portion of the receptacle type electrical connector 60 and the shielding conductor 22 of the flat circuit device 11 on the side of the plug type electrical connector 55 is connected through the conductive shells 13 and 14 with the conductive shell 62 constituting the ground connecting portion of the receptacle type electrical connector 60. As a result, the shielding conductors 21 and 22 are electrically connected with the grounding portion provided on the solid printed circuit board to which the receptacle type electrical connector 60 is fixed.

As shown in FIGS. 20 and 21, the receptacle type electrical connector 60 is provided with a positioning protrusion 69 which projects for engaging with an engaging aperture provided on the solid printed circuit board to which the receptacle type electrical connector 60 is fixed.

With the plug type electrical connector 55 constituting the first embodiment of electrical connector according to the present invention described above, it is not required to provide an insulated housing or any insulator corresponding to the insulated housing as a structural element. As a result, the plug type electrical connector 55 can be obtained with a reduced size in a direction of the thickness of the flat circuit device 11, a relatively small number of constructive parts and reduced assembling steps and time and at a production cost reduced effectively. In addition, since the plug type electrical connector 55 is not provided with the insulated housing or any insulator corresponding to the insulated housing, the problem that the insulated housing is required to be processed with extremely high precision because various structural members or parts are positioned with reference to the insulated housing, is avoided with the plug type electrical connector 55, and each of the structural members or parts of the plug type electrical connector 55 is not required to be processed with extremely high precision.

Further, in the plug type electrical connector 55, the contacting terminals 17*a* and the end portion 21*a* of the shielding conductor 21 provided on the flat circuit device 11 is exposed on the connectively engaging protrusion 18 supported by the supporting board portion 19 at the end portion 12 of the flat circuit device 11 and held by the conductive shells 13 and 14, so that, when the connectively engaging protrusion 18 is put in engagement with the receptacle type electrical connector 60, the contacting terminals 17*a* come into press-contact with the conductive contacts 64 for signal transmission provided in the receptacle type electrical connector 60 and the end portion 21*a* of the shielding conductor 21 comes into press-contact with the conductive shell 62 constituting the ground connecting portion of the receptacle type electrical connector 60. Accordingly, a distance between a grounding path formed with the shielding conductor 21 provided on the flat circuit device 11 and the ground connecting portion provided in the receptacle type electrical connector 60 put in press-contact with the shielding conductor 21 and each of the contacting terminals 17*a* arranged on the connectively engaging protrusion 18 of the flat circuit device 11 can be kept constant, and therefore, variations in characteristic impedance of each of the contacting terminals 17*a* through which signals are transmitted can be effectively suppressed.

Further, in the plug type electrical connector 55, since the pressing tongues 31 and 34 provided on the conductive shell 13 is operative to come into press-contact with the end surface between the first and second surfaces of the supporting board portion 19 formed with the end portion 12 of the flat circuit device 11 so as to position appropriately and fix stably the conductive shell 13 in regard to the supporting board portion 19, the conductive shell 13 can be attached surely to the supporting board portion 19 with a minimized size in the direction of the thickness of the flat circuit device 11.

Figure 22:
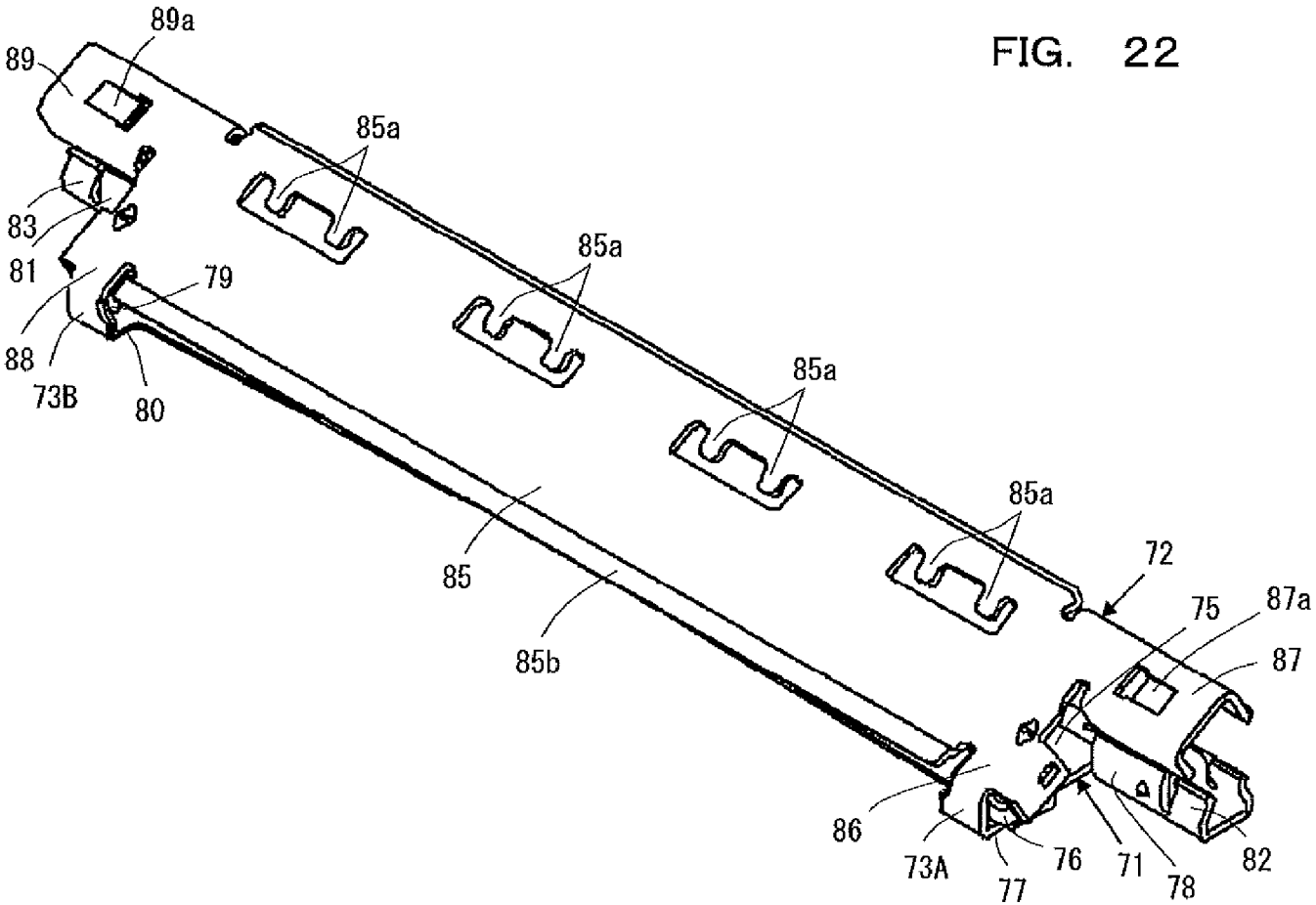
FIG. 22 is a schematic perspective view showing a couple of conductive shells constituting constitutive elements of a second embodiment of electrical connector according to the present invention.

FIG. 22 shows conductive shells 71 and 72 and a pair of connecting members 73A and 73B for connecting the conductive shell 71 with the conductive shell 72, which constitute constitutive elements of a second embodiment of electrical connector according to the present invention, together with the end portion 12 of the flat circuit device 11 shown in FIG. 1 and the manipulative lever 15 shown in FIG. 2.

The conductive shells 71 and 72 and the connecting members 73A and 73B through which the conductive shells 71 and 72 are connected with each other are incorporated as a single element and formed by means of punching and bending a resilient metallic plate, for example.

The conductive shell 71 is formed in the same manner as the conductive shell 13 shown in FIGS. 2 and 7 to have a slender plate portion 75. A pressing tongue 76 and engaging portions 77 and 78 are provided on one of end portions of the slender plate portion 75 opposite to each other and a pressing tongue 79 and engaging portions 80 and 81 are provided on the other of end portions of the slender plate portion 75. Further, a stopper member 82 is provided for projecting from the engaging portion 78 to the outside and a stopper member 83 is provided for projecting from the engaging portion 81 to the outside.

Similarly, the conductive shell 72 is formed in the same manner as the conductive shell 14 shown in FIGS. 2, 8 and 9 to have a slender plate portion 85. Engaging portions 86 and 87 are provided on one of end portions of the slender plate portion 85 opposite to each other and engaging portions 88 and 89 are provided on the other of end portions of the slender plate portion 85. In addition, a plurality of pressing tongues 85*a* are formed at predetermined intervals in the slender plate portion 85. Further, a pressing tongue 87*a* is formed in the engaging portion 87 and a pressing tongue 89*a* is formed in the engaging portion 89.

The engaging portion 77 of the conductive shell 71 and the engaging portion 86 of the conductive shell 72 are connected with each other through the connecting member 73A and the engaging portion 80 of the conductive shell 71 and the engaging portion 88 of the conductive shell 72 are connected with each other through the connecting member 73B. The connecting members 73A and 73B are operative to cause the slender plate portion 75 of the conductive shell 71 and the slender plate portion 85 of the conductive shell 72 to face each other.

The conductive shell 71 is attached to the supporting board portion 19 of the flat circuit device 11 shown in FIG. 1 in the same manner as the conductive shell 13 attached to the supporting board portion 19. When the conductive shell 71 is attached to the supporting board portion 19, first, the flat circuit device 11 is put between the conductive shells 71 and 72 connected with each other through the connecting members 73A and 73B as shown in FIG. 22 and then the conductive shell 71 is fixed to the supporting board portion 19 with an inner surface of the slender plate portion 75 thereof placed to face the first surface of the supporting board portion 19.

On that occasion, a portion of the engaging portion 78 of the conductive shell 71 is put in engagement with the engaging edged recess 20A provided on the flat circuit device 11, a portion of the engaging portion 81 of the conductive shell 71 is put in engagement with the engaging edged recess 20B provided on the flat circuit device 11, and the pressing tongues 76 and 79 of the conductive shell 71 come into press-contact with an end surface between the first and second surfaces of the supporting board portion 19, so that the conductive shell 71 is positioned appropriately to the supporting board portion 19. As a result, the conductive shell 71 is attached to the supporting board portion 19 of the flat circuit device 11 with the slender plate portion 75 thereof which covers directly the first surface of the supporting board portion 19 without any insulator or the like put between the slender plate portion 75 and the first surface of the supporting board portion 19.

Next, the manipulative lever 15 shown in FIG. 2 is put in process of mounting on the conductive shell 71 which is attached to the supporting board portion 19 of the flat circuit device 11. When the manipulative lever 15 is mounted on the conductive shell 71, the end portion 48 of the manipulative lever 15 is held to be rotatable by one of the end portions of the slender plate portion 75 of the conductive shell 71 in such a manner that the axial portion 50 provided on the end portion 48 is put in the engaging portion 78 of the conductive shell 71 and prevented from getting out of the engaging portion 78 by the stopper member 82 of the conductive shell 71 and the end portion 49 of the manipulative lever 15 is held to be rotatable by the other of the end portions of the slender plate portion 75 of the conductive shell 71 in such a manner that the axial portion 51 provided on the end portion 49 is put in the engaging portion 81 of the conductive shell 71 and prevented from getting out of the engaging portion 81 by the stopper member 83 of the conductive shell 71. As a result, the manipulative lever 15 is mounted to be rotatable on the conductive shell 71.

After that, the conductive shell 72 is put in process of attachment to the conductive shell 71 which is attached to the supporting board portion 19 of the flat circuit device 11. When the conductive shell 72 is attached to the conductive shell 71, an inner surface of the slender plate portion 85 of the conductive shell 72 is placed to face the second surface of the supporting board portion 19.

Figure 23:
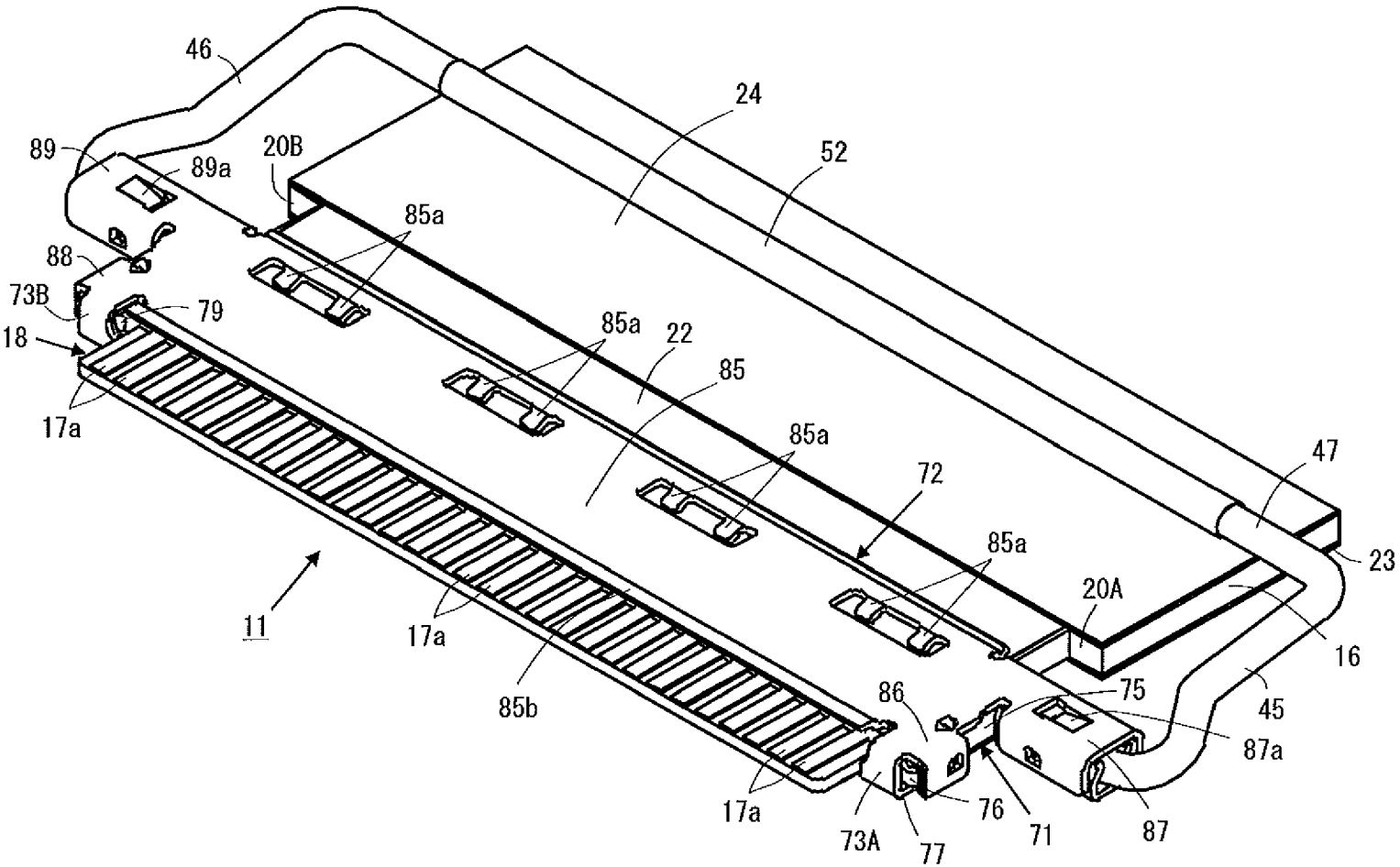
FIG. 23 is a schematic perspective view showing the second embodiment of electrical connector according to the present invention.

On that occasion, the engaging portions 86 and 88 of the conductive shell 72 are put in engagement respectively with the engaging portions 77 and 80 of the conductive shell 71 and the engaging portions 87 and 89 of the conductive shell 72 are put in engagement respectively with the engaging portions 78 and 81 of the conductive shell 71, so that the conductive shell 72 is positioned appropriately to the supporting board portion 19 of the flat circuit device 11 to which the conductive shell 71 is attached. As a result, as shown in FIGS. 23 and 24, the conductive shell 72 is attached to the conductive shell 71 which is attached to the supporting board portion 19 of the flat circuit device 11 with the slender plate portion 85 thereof which covers directly the second surface of the supporting board portion 19 without any insulator or the like put between the slender plate portion 85 and the second surface of the supporting board portion 19 and with the pressing tongues 87*a* and 89*a* formed respectively in the engaging portions 87 and 89 which are operative to restrain in position the end portions 48 and 49 of the manipulative lever 15 put respectively in the engaging portions 78 and 81 of the conductive shell 71.

Figure 24:
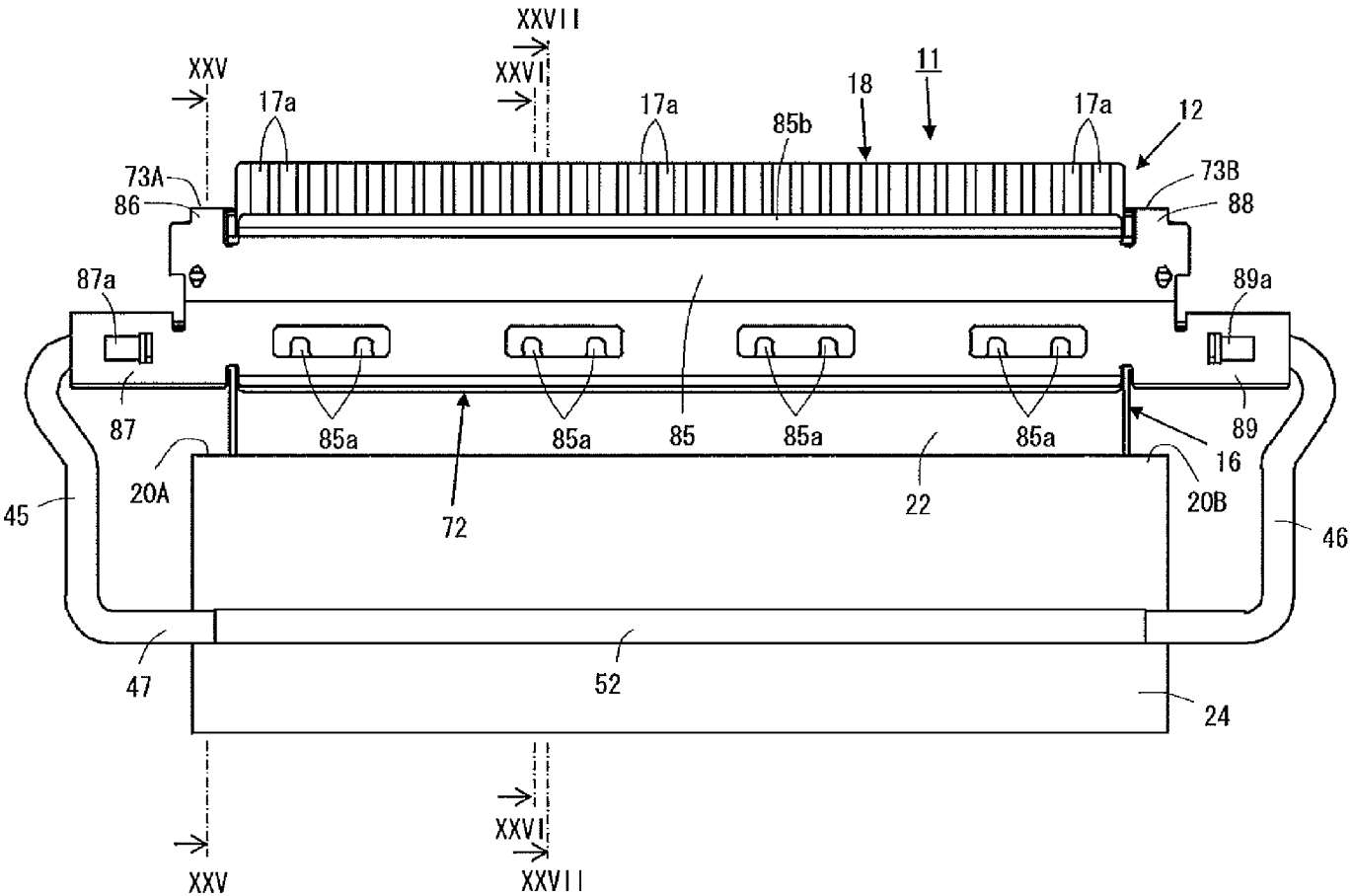
FIG. 24 is a schematic plan view showing the second embodiment of electrical connector according to the present invention.
Figure 25:
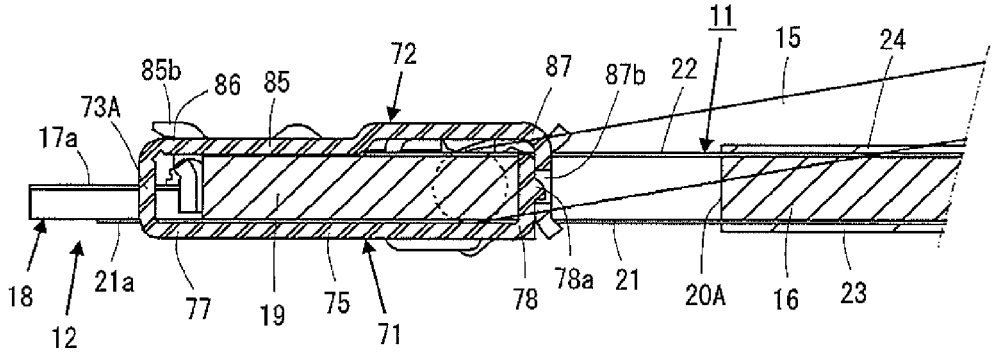
FIG. 25 is a schematic cross sectional view taken along line XXV-XXV in FIG. 24.
Figure 26:
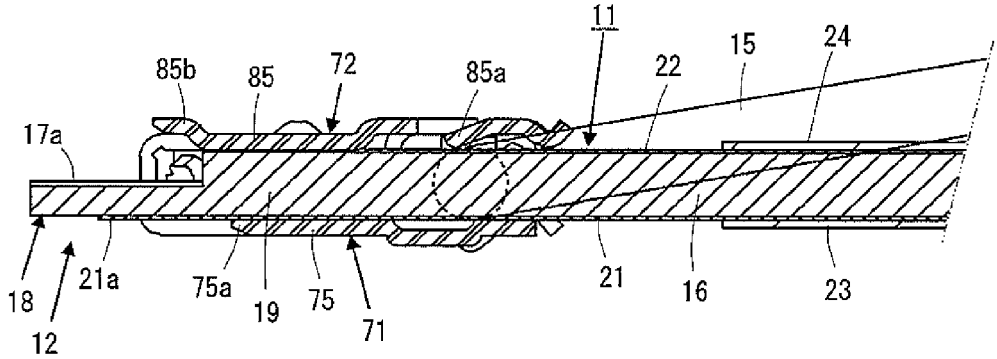
FIG. 26 is a schematic cross sectional view taken along line XXVI-XXVI in FIG. 24.
Figure 27:
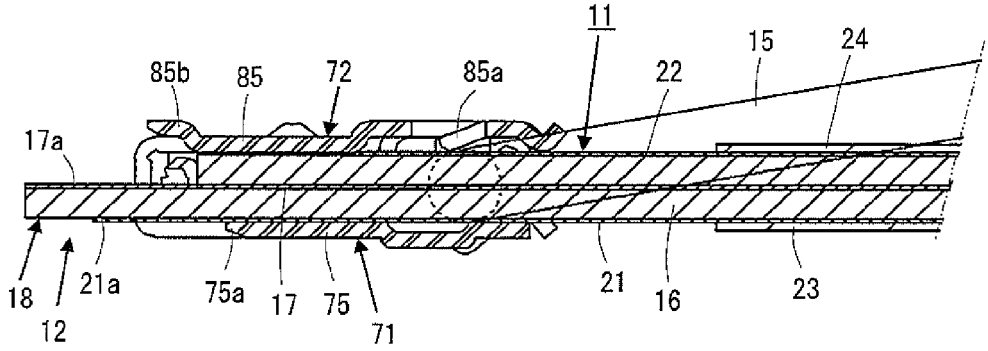
FIG. 27 is a schematic cross sectional view taken along line XXVII-XXVII in FIG. 24.

Under a condition wherein the conductive shell 71 is attached to the supporting board portion 19 constituted with the end portion 12 of the flat circuit device 11, the manipulative lever 15 is mounted to be rotatable on the conductive shell 71 and the conductive shell 72 is attached to the conductive shell 71 which is attached to the supporting board portion 19 in such a manner as described above, the engaging portion 77 of the conductive shell 71 and the engaging portion 86 of the conductive shell 72 are connected with each other through the connecting member 73A, as shown also in FIG. 25 which shows a cross sectional view taken along line XXV-XXV in FIG. 24 and the engaging portion 80 of the conductive shell 71 and the engaging portion 88 of the conductive shell 72 are connected with each other through the connecting member 73B, so that the slender plate portion 75 of the conductive shell 71 and the slender plate portion 85 of the conductive shell 72 are located to be opposite to each other with the supporting board portion 19 between, as shown also in FIGS. 26 and 27 which show cross sectional views taken along lines XXVI-XXVI and XXVII-XXVII in FIG. 24, respectively. The slender plate portion 75 of the conductive shell 71 covers directly the first surface of the supporting board portion 19 and the slender plate portion 85 of the conductive shell 72 covers directly the second surface of the supporting board portion 19.

As shown in FIG. 25, an engaging aperture 87*b* formed in the engaging portion 87 of the conductive shell 72 engages with an engaging projection 78*a* provided on the engaging portion 78 of the conductive shell 71 so that the engaging portion 87 of the conductive shell 72 is engaged with the engaging portion 78 of the conductive shell 71. Similarly, although detailed illustrations in the drawings are omitted, an engaging aperture formed in the engaging portion 89 of the conductive shell 72 engages with an engaging projection provided on the engaging portion 81 of the conductive shell 71 so that the engaging portion 89 of the conductive shell 72 is engaged with the engaging portion 81 of the conductive shell 71.

Further, as shown in FIGS. 26 and 27, the slender plate portion 75 of the conductive shell 71 covering the first surface of the supporting board portion 19 comes directly and electrically into contact with the shielding conductor 21 provided on the supporting board portion 19, and thereby, the conductive shell 71 is electrically connected with the shielding conductor 21. Similarly, the pressing tongue 85*a* formed in the slender plate portion 85 of the conductive shell 72 covering the second surface of the supporting board portion 19 comes electrically into press-contact with the shielding conductor 22 provided on the supporting board portion 19, and thereby, the conductive shell 72 is electrically connected with the shielding conductor 22.

Then, as shown in FIGS. 23 to 27, the connectively engaging protrusion 18 on which the contacting terminals 17*a* are arranged projects from an end portion 85*b* between the engaging portions 86 and 88 provided on the slender plate portion 75 of the conductive shell 72 covering the second surface of the supporting board portion 19 to the outside so that the contacting terminals 17*a* are exposed on one of a pair of mutually opposite surfaces of the connectively engaging protrusion 18.

Further, as shown in FIGS. 26 and 27, the connectively engaging protrusion 18 on which the end portion 21*a* of the shielding conductor 21 is provided projects from an end portion 75*a* between the engaging portions 77 and 80 provided on the slender plate portion 75 of the conductive shell 71 covering the first surface of the supporting board portion 19 to the outside so that the end portion 21*a* of the shielding conductor 21 extending along the terminal arrangement direction is exposed on the other of the mutually opposite surfaces of the connectively engaging protrusion 18.

As a result, the conductive shell 71 having the slender plate portion 75 which covers directly the first surface of the supporting board portion 19 constituted with the end portion 12 of the flat circuit device 11 and the conductive shell 72 having the slender plate portion 85 which covers directly the second surface of the supporting board portion 19 and is positioned across the supporting board portion 19 from the slender plate portion 75, are to be hold the connectively engaging protrusion 18 supported by the supporting board portion 19 in such a manner that the contacting terminals 17*a* and the end portion 21*a* of the shielding conductor 21 are exposed on the connectively engaging protrusion 18, and thereby, the second embodiment of electrical connector according to the present invention is obtained. The second embodiment of electrical connector thus obtained in accordance with the present invention functions as a plug type electrical connector operative to be engaged with a mating electrical connector functioning as a receptacle type electrical connector.

Accordingly, in the second embodiment of electrical connector according to the present invention, the conductive shells 71 and 72 hold the connectively engaging protrusion 18 so as to cause the connectively engaging protrusion 18 to be engaged with the mating electrical connector with the contacting terminals 17*a* and the end portion 21*a* of the shielding conductor 21 exposed thereon.

The second embodiment of electrical connector thus constituted in accordance with the present invention is used to be engaged with a receptacle type electrical connector, such as the receptacle type electrical connector 60 shown in FIG. 17, in the same manner as the plug type electrical connector 55 constituting the first embodiment of electrical connector according to the present invention.

With the second embodiment of electrical connector according to the present invention described above, advantages same as those obtained by the plug type electrical connector 55 constituting the first embodiment of electrical connector according to the present invention can be obtained, and in addition, since the conductive shells 71 and 72 are connected through the connecting members 73A and 73B with each other to be incorporated, the conductive shells 71 and 72 can be obtained easily and simultaneously, for example, by means of punching and bending a metallic plate and the assembly of the second embodiment of electrical connector according to the present invention using the conductive shells 71 and 72 can be easily carried out so as to reduced further the production cost of the second embodiment of electrical connector according to the present invention.

What is claimed is:

1. An electrical connector comprising:

an end portion of a flat circuit device which forms a connectively engaging protrusion on which a plurality of contacting terminals are arranged and a supporting board portion for supporting the connectively engaging protrusion, and first and second conductive shells having respectively first and second plate portions opposite to each other with the supporting board portion between, wherein said flat circuit device has a board—shaped insulating base on which said connectively engaging protrusions and said supporting board portion are provided and in which a plurality of strip—shaped conductors are buried and arranged in parallel with each other and to form with end portions thereof respectively, said contacting terminals are arranged on said connectively engaging protrusion to expose to the outside of said board—shaped insulating base for coming into contact directly and respectively with conductive contacts of a mating electrical connector, wherein said first conductive shell is attached to said supporting board portion with said first plate portion thereof covering directly a first surface of said supporting board portion and said second conductive shell is attached also to said supporting board portion with said second plate portion thereof covering directly a second surface opposite to said first surface of said supporting board portion, so that said first and second conductive shells are operative to hold said connectively engaging protrusion supported by said supporting board portion at said end portion of said flat circuit device for causing the same to engage with said mating electrical connector in such a manner that said contacting terminals are exposed on said collectively engaging protrusion, and wherein said first conductive shell is provided with a pressing tongue operative to come into press—contact with an end surface provided between said first and second surfaces of said supporting board portion to be perpendicular to each of said first and second surfaces.

2. An electrical connector according to claim 1, wherein a part of a shielding conductor provided on the flat circuit device is exposed on the connectively engaging protrusion supported by the supporting board portion at the end portion of the flat circuit device.

3. An electrical connector according to claim 1, wherein the first conductive shell has first engaging portions provided respectively on both end portions thereof in a direction along which the contacting terminals are arranged, the second conductive shell has second engaging portions provided respectively on both end portions thereof in the direction along which the contacting terminals are arranged, and the first and second engaging portions are engaged with each other when the second conductive shell is attached to the first conductive shell.

4. An electrical connector according to claim 1, wherein each of the first and second conductive shells is formed independently.

5. An electrical connector according to claim 1 further comprising a manipulative lever mounted to be rotatable on the first conductive shell, said manipulative lever being provided with a pair of end portions each forming an axial portion held to be rotatable by one of end portions of the first conductive shell in the direction along which the contacting terminals are arranged and operative to be manipulated to rotate in regard to the first and second conductive shells to engage with the mating electrical connector so that the connective engaging protrusion and the mating electrical connector are maintained in mutual engagement.

6. An electrical connector according to claim 1 further comprising a connecting member for connecting the first and second conductive shells with each other to be incorporated and causing the first plate portion of the first conductive shell and the second plate portions of the second conductive shell to be opposite to each other.

7. An electrical connector according to claim 6, wherein a pair of connecting members are provided, each of said connecting members being operative to connect one of end portions of the first conductive shell in the direction along which the contacting terminals are arranged and one of end portions of the second conductive shell in the direction along which the contacting terminals are arranged with each other.

* * * * *